US007995081B2

(12) United States Patent
Stowe et al.

(10) Patent No.: US 7,995,081 B2
(45) Date of Patent: Aug. 9, 2011

(54) ANISOTROPICALLY CONDUCTIVE BACKSIDE ADDRESSABLE IMAGING BELT FOR USE WITH CONTACT ELECTROGRAPHY

(75) Inventors: Timothy D. Stowe, Alameda, CA (US); Chu-heng Liu, Penfield, NY (US); Jeng Ping Lu, Fremont, CA (US); Eugene Chow, Fremont, CA (US); Gregory B. Anderson, Emerald Hills, CA (US); Armin Völkel, Mountain View, CA (US); Eric Peeters, Fremont, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 634 days.

(21) Appl. No.: 12/145,677

(22) Filed: Jun. 25, 2008

(65) Prior Publication Data

US 2009/0322845 A1 Dec. 31, 2009

(51) Int. Cl.
*B41J 2/41* (2006.01)

(52) U.S. Cl. ..... 347/112

(58) Field of Classification Search ..... 347/111, 347/112, 141, 142, 145, 147; 118/621, 624, 118/625

See application file for complete search history.

(56) References Cited

U.S. PATENT DOCUMENTS

| | | | |
|---|---|---|---|
| 4,288,801 | A | 9/1981 | Ronen |
| 4,288,802 | A | 9/1981 | Ronen |
| 4,288,803 | A | 9/1981 | Ronen |
| 4,288,806 | A | 9/1981 | Ronen |
| 4,290,077 | A | 9/1981 | Ronen |
| 4,290,078 | A | 9/1981 | Ronen |
| 4,356,501 | A | 10/1982 | Ronen |
| 4,404,576 | A | 9/1983 | Ronen |
| 4,409,603 | A | 10/1983 | Goffe |
| 4,422,087 | A | 12/1983 | Ronen |
| 4,984,041 | A | 1/1991 | Hack et al. |
| 5,105,246 | A | 4/1992 | Da Costa |
| 5,166,960 | A | 11/1992 | Da Costa |
| 5,237,346 | A | 8/1993 | Da Costa et al. |
| 5,374,981 | A | 12/1994 | Yamamoto et al. |
| 5,483,269 | A | 1/1996 | van Stiphout et al. |
| 5,613,861 | A | 3/1997 | Smith et al. |

(Continued)

FOREIGN PATENT DOCUMENTS

DE 100 30 872 A1 2/2001

(Continued)

OTHER PUBLICATIONS

Btechcorp. Highly Thermally and Electrically Conductive Z-Axis Film Adhesives, http://www.btechcorp.com, accessed Aug. 27, 2007, 2 pgs.

*Primary Examiner* — Huan H Tran
(74) *Attorney, Agent, or Firm* — Fay Sharpe LLP

(57) ABSTRACT

An addressable imaging belt for use in printing applications having embedded anisotropically conductive addressable islands configured for electric contact on a first side of the belt by a write head consisting of an array of compliant cantilevered fingers with contact pads/points to which a voltage can be applied. The conductive addressable islands electrically isolated from one another and extending substantially through the thickness of the belt in order to allow charge to flow through the belt towards a second side of the belt, in order to form a latent electrostatic image on the second side and develop this latent image by attracting colorized toner or other electrically charged particles to the second side.

20 Claims, 17 Drawing Sheets

U.S. PATENT DOCUMENTS

| | | | |
|---|---|---|---|
| 5,695,847 | A | 12/1997 | Browne |
| 5,812,170 | A | 9/1998 | Kuehnle et al. |
| 5,849,130 | A | 12/1998 | Browne |
| 5,937,248 | A | 8/1999 | Liu et al. |
| 5,991,577 | A | 11/1999 | Liu et al. |
| 5,991,578 | A | 11/1999 | Liu et al. |
| 5,991,582 | A | 11/1999 | Liu et al. |
| 6,009,294 | A | 12/1999 | Liu et al. |
| 6,014,157 | A | 1/2000 | Slot et al. |
| 6,045,679 | A | 4/2000 | Slot et al. |
| 6,049,683 | A | 4/2000 | Liu et al. |
| 6,068,960 | A | 5/2000 | Pai et al. |
| 6,117,602 | A | 9/2000 | Liu et al. |
| 6,122,471 | A | 9/2000 | Liu et al. |
| 6,127,077 | A | 10/2000 | Pai et al. |
| 6,184,911 | B1 | 2/2001 | Tombs |
| 6,195,520 | B1 | 2/2001 | Liu et al. |
| 6,219,501 | B1 | 4/2001 | Zhao et al. |
| 6,256,468 | B1 | 7/2001 | Liu |
| 6,289,191 | B1 | 9/2001 | Liu et al. |
| 6,311,035 | B1 | 10/2001 | Liu et al. |
| 6,349,190 | B1 | 2/2002 | Liu et al. |
| 6,362,845 | B1 | 3/2002 | Genovese |
| 6,438,332 | B2 | 8/2002 | Zhao et al. |
| 6,473,107 | B2 | 10/2002 | Koga et al. |
| 6,515,692 | B2 | 2/2003 | Koga et al. |
| 6,518,990 | B2 | 2/2003 | Koga et al. |
| 6,553,205 | B1 | 4/2003 | Liu |
| 6,618,065 | B2 | 9/2003 | Koga et al. |
| 6,646,663 | B2 | 11/2003 | Kamoshida et al. |
| 6,650,349 | B2 | 11/2003 | Koga et al. |
| 6,661,442 | B2 | 12/2003 | Koga et al. |
| 6,750,891 | B2 | 6/2004 | Kamoshida et al. |
| 6,912,082 | B1 | 6/2005 | Lu et al. |
| 7,286,149 | B2 * | 10/2007 | Peeters ..... 347/141 |
| 7,342,596 | B2 * | 3/2008 | Peeters ..... 347/141 |
| 2003/0113137 | A1 | 6/2003 | Liu et al. |
| 2004/0114963 | A1 | 6/2004 | Pan et al. |
| 2005/0155508 | A1 | 7/2005 | Vaidyanathan et al. |
| 2005/0259140 | A1 | 11/2005 | Kim et al. |
| 2006/0124013 | A1 | 6/2006 | Peeters |

FOREIGN PATENT DOCUMENTS

| | | | |
|---|---|---|---|
| DE | 100 44 908 | A1 | 4/2001 |
| DE | 100 30 163 | A1 | 1/2002 |
| DE | 100 30 164 | A1 | 1/2002 |
| DE | 100 30 165 | A1 | 1/2002 |
| DE | 100 30 166 | A1 | 1/2002 |
| DE | 100 30 171 | A1 | 1/2002 |
| DE | 100 30 178 | A1 | 1/2002 |
| DE | 100 30 180 | A1 | 1/2002 |
| DE | 101 24 587 | A1 | 1/2002 |
| DE | 101 24 588 | A1 | 1/2002 |
| DE | 101 24 589 | A1 | 1/2002 |
| EP | 0 020 164 | B1 | 10/1980 |
| EP | 0 335 632 | B1 | 10/1989 |
| EP | 0 635 768 | B1 | 1/1995 |

* cited by examiner

ANISOTROPICALLY CONDUCTIVE BACKSIDE ADDRESSABLE IMAGING BELT FOR USE WITH CONTACT ELECTROGRAPHY

BACKGROUND

The present application is directed to contact electrography, and more particularly to an addressable imaging belt configuration for use in a contact electrographic system.

Xerography, also referred to as electro-photography, can be broken down into seven basic steps: (i) Charging of a photoconductive drum or belt with a scorotron; (ii) Latent image formation by image wise discharge using a raster optical scanner (ROS) or LED array; (iii) Development of toner (either two component or monocomponent) supplied from a donor roll; (iv) Electrostatic toner transfer to an intermediate belt; (v) Transfer from the intermediate belt to paper; (vi) Fusing of the toner onto the paper under high temperature and pressure; and (vii) Cleaning and erasing of the photoreceptor and intermediate transfer belts.

At the low end of the digital printing market, traditional xerography is being threatened by much simpler lower cost marking technologies. For example, in the small office/home office (SOHO) market, printing is dominated by lower cost ink jet approaches. In the high end commercial printing market, it is difficult for xerography to address the substrate latitude and wide media format that quick turn computer to press offset lithography systems can offer. In addition, factoring in service and consumable expenses, quick turn lithography presses have a lower cost structure for run lengths as short as 500 pages.

An advantage xerography still maintains is the ability to print a full page of variable data at higher speeds than drop on demand ink jet printing. Thus a means for reducing the complexity of xerography while increasing substrate latitude and media format in a cost effective manner has the potential to increase the market share for xerographic printing.

One long standing idea for simplifying xerographic printing is to use a direct write concept known as contact electrography. FIG. 1 illustrates a conceptual view of a contact electrographic system 10 which includes a write head array 12, having a series of closely spaced cantilevers 14 to directly address a surface 16 of a dielectric imaging drum 18. This process is used to form an electrostatic image onto the dielectric imaging drum 18 by making direct contact to the surface and of the imaging drum 18. Thus contact electrography can eliminate the need for the ROS optical subsystem and associated subtle print artifacts.

Here, an image-wise charge pattern is formed onto a retaining dielectric drum using a write head containing an array of electrode elements in contact with the drum. Imaging is then accomplished by selectively applying a high voltage to the electrodes to induce charge onto the drum surface or by selectively applying a grounding potential to erase charge from this surface. Additionally, a common potential can be applied to all electrodes and then such electrodes can be made to selectively bend further and thereby selectively touch the charge retaining surface. While these type of contact electrography reduces front end complexity, it has suffered from other imaging problems including but not limited to: (i) Non-uniformity of the charge written into a dielectric by the electrode arrays; (ii) Non-repeatable dielectric charging due to variations in contact pressure (iii) Ghosting caused by not being able to fully erase trapped charges; (iv) Reduced signal-to-noise (S/N) development due to triboelectric noise and low voltage requirements imposed by lateral air breakdown limitations between nearest neighbor electrodes; and (v) Contamination of the write electrode array ahead from debris and residual toner.

(i-iii) Contact Charging Uniformity, Repeatability, and Ghosting Issues

Uniformity is an issue that plagues any printing technology that relies on an array of elements to write either a latent electrostatic image or a directly marked image on paper. The need to tune the performance of individual writing elements, calibrate their performance over temperature, or build in redundancy for dead elements dramatically adds to the overall cost. In addition, the need for adding circuits that can address these elements can also be complex and costly.

Uniformity issues in contact electrography arise from variations in contact pressure and tip geometry. These issues are compounded by vibrations of the drum which change the relative pressure onto the dielectric and by non-uniformly wear of the tip shape over time. These phenomenon lead to changes in stored charge which can lead to toner development curve shifts, mottle, and banding. In addition to these serious issues, there are mottle issues related to tribo-charging from the friction between the write electrodes and the dielectric. Typical variations in charge densities of only a few percent can lead to observable fluctuations in toner pile height and mottle.

To eliminate such problems a concept as disclosed in U.S. Pat. No. 6,362,845, entitled "Method and Apparatus for Electrostostatographic Printing Utilizing an Electrode Array and a Charge Retentive Imaging Member," by Genovese, Issued Mar. 26, 2002, hereby incorporated by reference in its entirety, and illustrated in FIG. 2, teaches a contact electrographic system 20 where contact between a write head print array 22 and an imaging belt (or imaging drum) 24 is through use of uniform metal islands 26 lithographically defined and patterned on the top, upper or imaging surface of the imaging belt (or imaging drum) 24.

In this approach, the amount of charge stored is not varied due to subtle differences in the electrode shape or pressure of the electrode tip on the metal island surface because the charge stored is determined only by the applied voltage and the capacitance of the metal island to a ground plane underneath. Previously written charge can easily be extracted from the metal islands by applying zero volts to the write electrode thus avoiding latent image ghosting. This is not the case for dielectric films because the charge can be immobilized due to deep charge traps in the insulating dielectric.

For the case where charge is deposited into an array of metal islands 26, the capacitance of an individual island is only on the order of 1 femtofarad. The RC time constant associated with direct charge injecting into an island is negligible compared to the RC time constant associated with parasitic capacitance of the electrode fingers. As long as the contact resistance to the islands is relatively low ($\ll K\Omega$) as would be the case for metal tip to metal island contact, the slew rate of the high voltage electronics is likely to be the time limiting step for writing. For example a page width addressable array built on glass, amorphous silicon high voltage (HV) transistors typically will not work faster than 100 kHz. Thus the total time for injecting charge can be consider to be on the order of 10 uS. This is more than adequate to print an entire 8½"×11" page at more than 500 ppm.

Another approach to creating charge storing topside metal islands include the use of randomly scattered metal particles embedded within a dielectric layer. Such an approach assumes the global dispersion of metal islands within a dielectric is such that islands do not come too close together so as to avoid shorting of adjacent writing electrodes and that the global uniformity of the dispersion leads to uniform prints. Such an approach also assumes that each electrode needs to encompass roughly the same touch area such that image uniformity is preserved. The advantage of this method is no lithography need be done in the manufacturing of the latent image carrier.

(iv) Low Voltage Development

Another issue with contact electrography is the need for a development system that works at voltages below the breakdown strength of air. This is not a problem for liquid toner systems which can operate well below 100V but the use of liquid toner is not desirable in the home or in the office. Most dry toner systems use two component magnetic brush development technologies requiring 500-600V difference between the imaging and non-imaging areas. Unfortunately, at such high voltages breakdown can occur in the air region just above the surface between adjacent metal islands or adjacent stylus tips. Such breakdown can lead to an increase in tip wear. Typically, the voltage applied cannot exceed around 400V before some form of lateral breakdown is observed. Therefore, a lower voltage development system needs to be used. FIG. 3 depicts an example of two toner development curves wherein one curve 33 represents a highly conductive two-component development magnetic brush system (CMB) and one line curve 34 represents a more typical semiconducting two component toner development system. FIG. 3 shows the CMB system can be optimized to perform well at only a 300V contrast potential difference between imaging and non-imaging areas. More particularly, FIG. 3 graphically illustrates the developed mass per unit area of toner is increased the more conductive a two component magnetic brush system becomes. Dotted line 32 shows the approximate layer thickness necessary to achieve full solid area coverage (1.5 monolayers) of EA toner. A conductive magnetic brush (CMB) system 33 has roughly twice the development efficiency as a semiconducting development curve 34 with the trade off that the CMB development curve has roughly twice the slope and thus there is increases sensitivity to small variations in the image potential of the latent imaging surface.

However the problem with using such a CMB development system together with a direct write architecture is that when the conductive development brush touches a conductive metal island it will electrically short the stored charge on the island. Thus the islands must somehow be shielded from direct contact with a CMB system but be accessible to contact electrostatic delivery of charge at the same time.

(v) Contamination Issues

Another problem for the direct contact approach is contamination. In a real system the latent imaging surface will come into contact will all sorts of debris and varying environmental conditions. A simple calculation shows that for an 8½"×11" page with 50% toner coverage, assuming roughly an average toner particle diameter of 5 microns, the number of toner particles printed on a single page is approximately 1 billion. Cleaning systems will remove most but not all of the residual toner left behind. This concept is illustrated in FIG. 4, which is a diagram of a contact electrographic system 40 including a latent image drum 42, having charged applied by a direct write head electrode array 44. As the charged latent image drum 42 rotates, a development roller 46 applies toner which is transferred to an image transfer drum 48, and then onto paper or other substrate 50. A cleaning brush 52 is used to remove residual toner 54 prior to the drum being re-written. As FIG. 4 illustrates, it is possible for some of this residual toner 54 to be missed by the cleaning brush 52. This missed residual toner 54 can become trapped underneath one of the electrodes on the direct write electrode array 44. Additionally, small (e.g., as small as micron sized) paper fibers can migrate through the system even though paper is never brought into direct contact with the latent imaging surface.

Unfortunately, a single toner particle trapped between a write electrode and the imaging surface could increase the contact resistance substantially above 100KΩ. Given a parallel parasitic capacitance of a write electrode finger could be as high as 1 nF, this RC time constant combination would then start to prohibit sufficient island charging at normal line printing speeds in the range of 4 kHz per line and lead to an unacceptable line defect across an entire print. In addition, the associated electrode abrasion from trapped toner debris could lead to the further spreading of surface contamination and lead to changes in imaging surface electrical leakage over time. These reliability issues pose a large hurdle to the practical implementation of contact electrography.

BRIEF DESCRIPTION

An addressable imaging belt for use in printing applications having embedded anisotropically conductive addressable islands configured for electric contact on a first side of the belt by a write head consisting of an array of compliant cantilevered fingers with contact pads/points to which a voltage can be applied. The conductive addressable islands electrically isolated from one another and extending substantially through the thickness of the belt in order to allow charge to flow through the belt towards a second side of the belt, in order to form a latent electrostatic image on the second side and develop this latent image by attracting colorized toner or other electrically charged particles to the second side.

DETAILED DESCRIPTION

Figure 1:
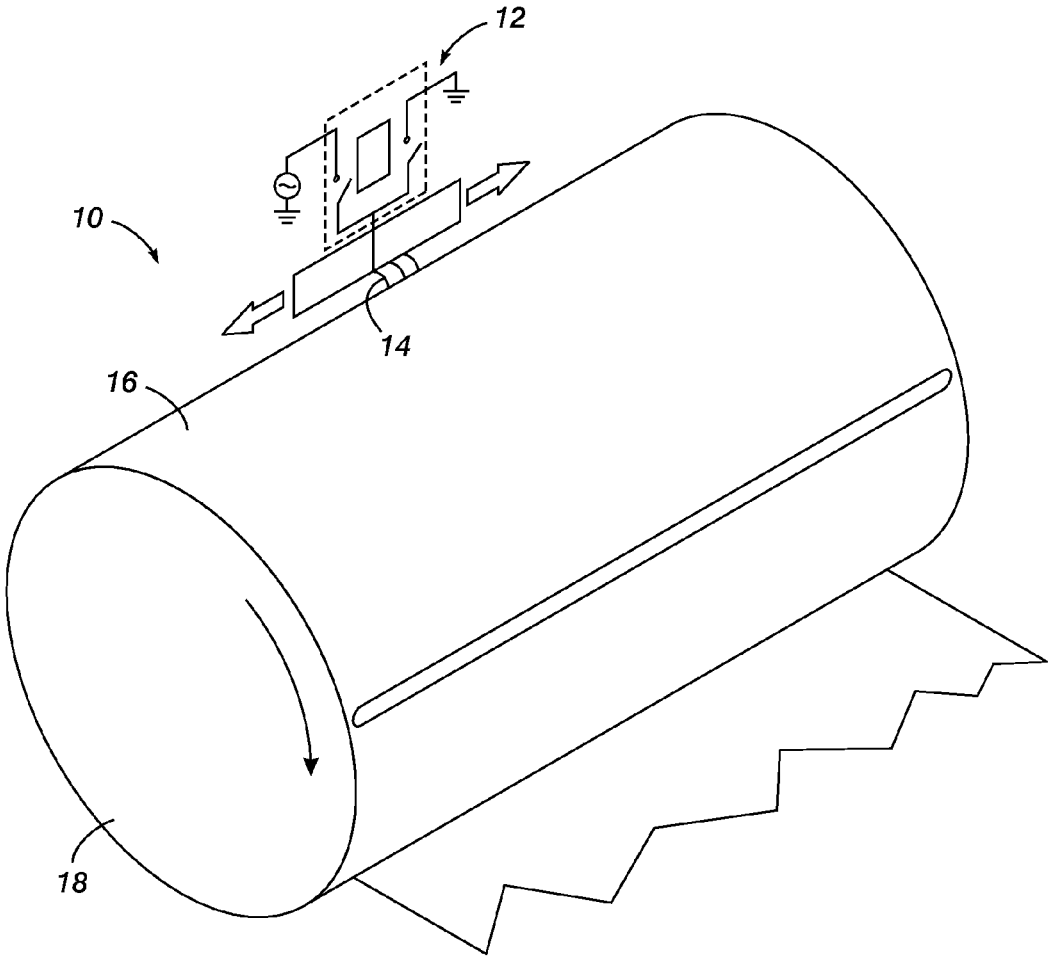
FIG. 1 is an illustration of a contact electrography system.
Figure 2:
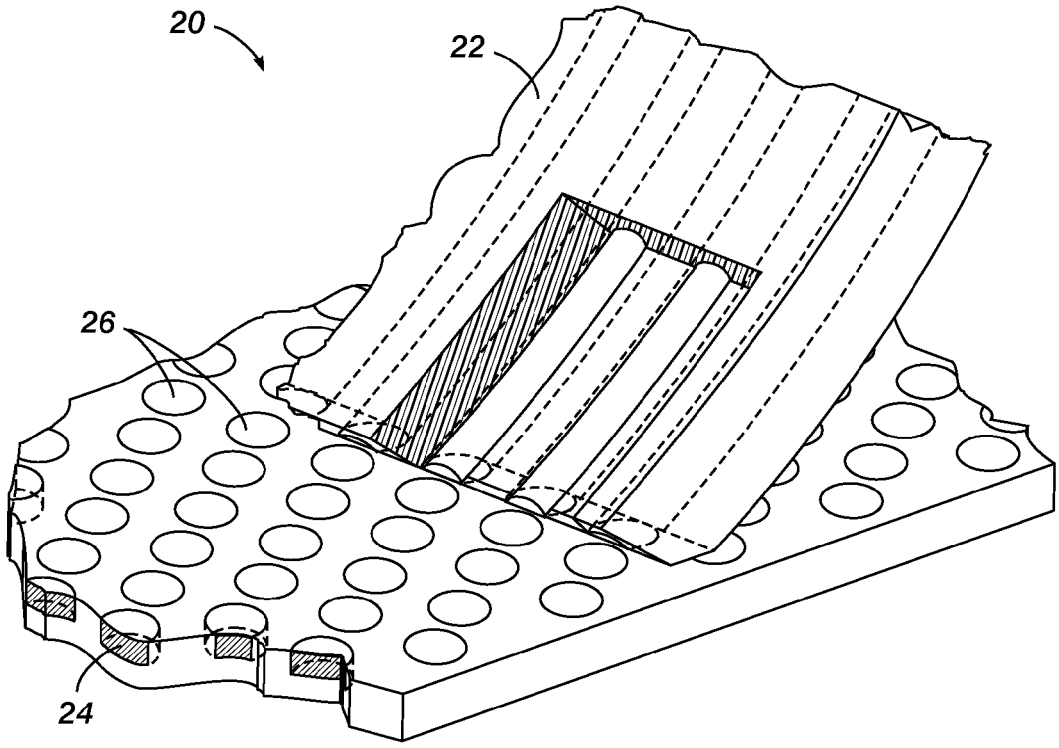
FIG. 2 is an illustration of a contact electrography system with embedded conductive islands for storing charge taken from U.S. Pat. No. 6,362,845.
Figure 3:
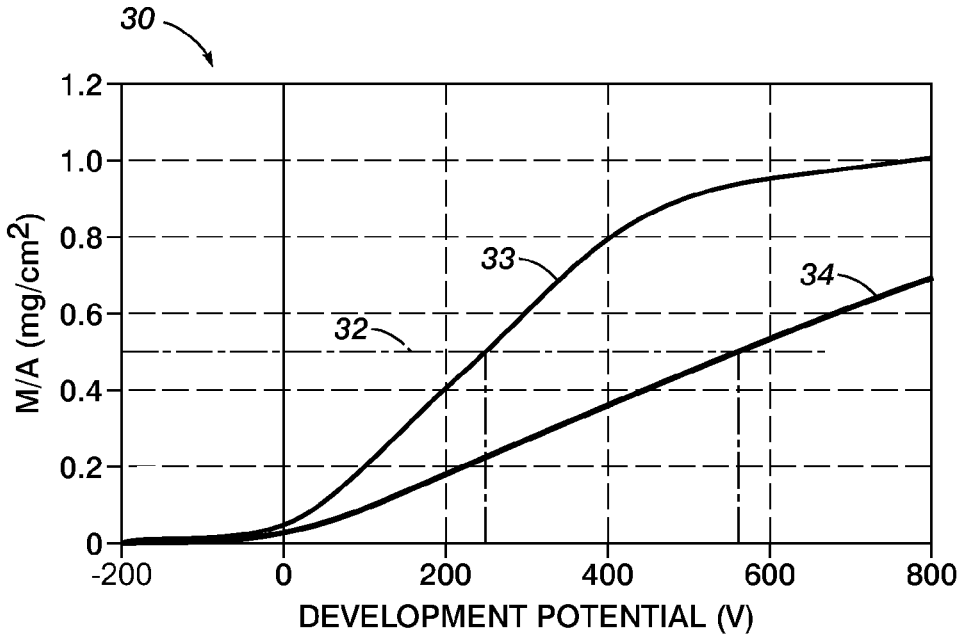
FIG. 3 is a graph which illustrates that the developed mass per unit area of toner is increased the more conductive a two component magnetic brush system becomes.
Figure 4:
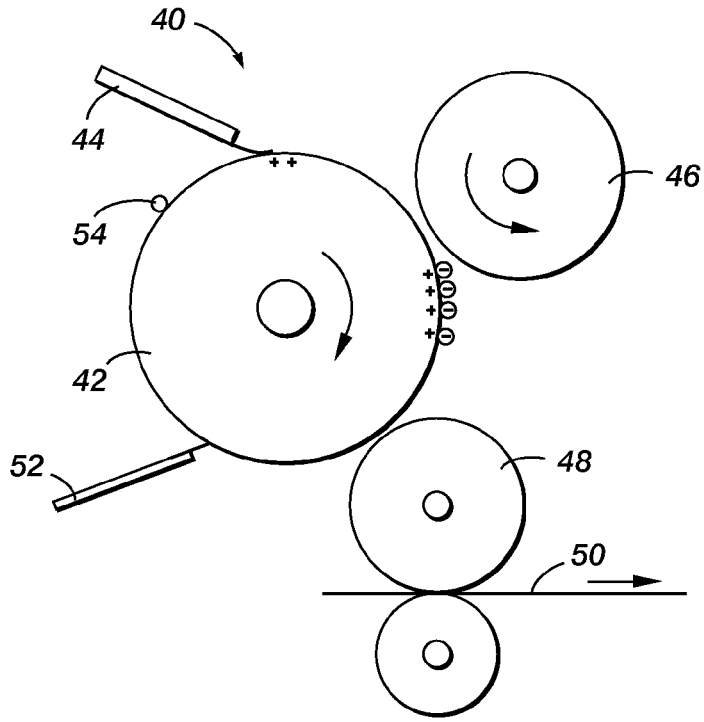
FIG. 4 is an illustration of the contamination problem that can occur when a toner particle is missed by the cleaning system.
Figure 5:
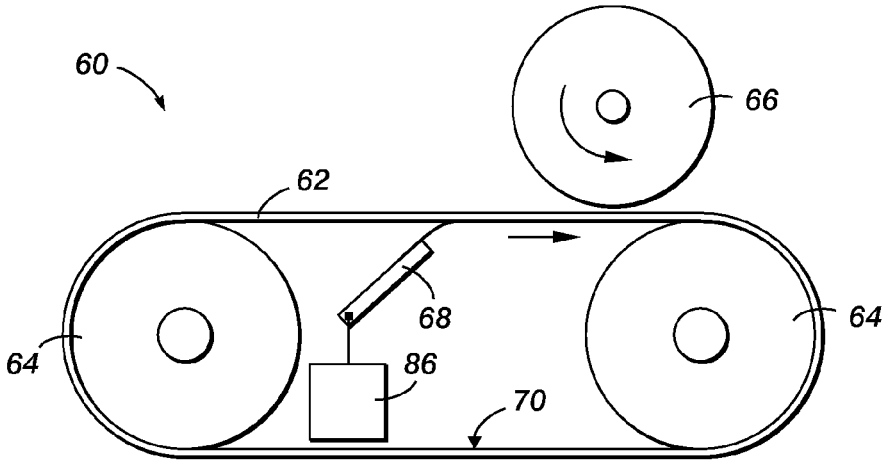
FIG. 5 is a depiction of an electrostatic imaging belt where charge is written on the bottom side (inside surface) of the belt and a toner image is developed on the top side (outside surface) of the belt.
Figure 6:
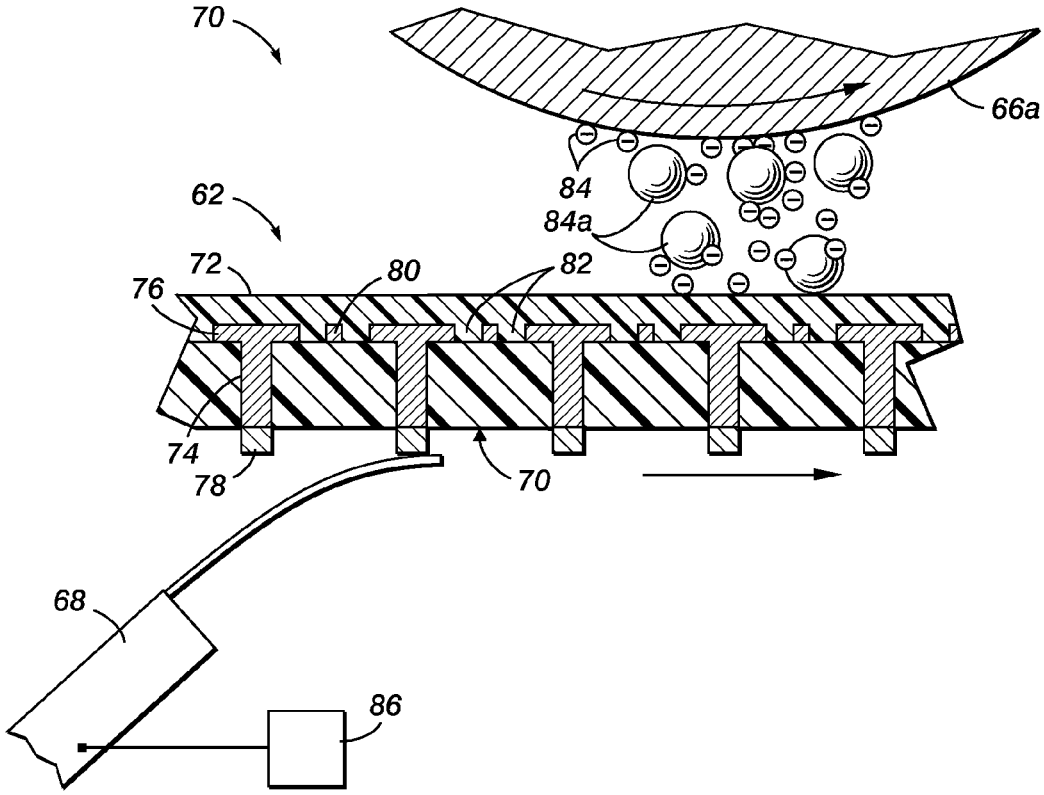
FIG. 6 is an illustration of a blown-up cross section of the addressable belt.

As FIGS. 1-4 have shown, existing contact electrography systems have certain shortcomings. It is therefore desirable to undertake improvements to existing contact electrographic systems. FIGS. 5 and 6 are schematic illustrations of a contact electrography system 60 constructed to eliminate mentioned reliability concerns, and which is capable of working with low voltage development systems such as, but not limited to, conductive magnetic brush (CMB) development systems.

The system 60 of FIG. 5 includes an electrostatic addressable imaging belt 62, rollers 64, a developer unit 66, and a write head array 68. In operation, and as shown in more detail in FIG. 6, charge is written on a first, bottom side or backside (inside surface) surface 70 of the belt, and a toner image is developed on a second or top side (outside surface) 72 of the belt. FIG. 6, also details a small number of the multitude of anisotropically addressable islands (also called herein conductive pillars) 74 which electrically link the inside and outside belt surfaces. More particularly, the blown-up cross-section of belt 62 illustrates anisotropically addressable islands 74 are partially embedded within and therefore may be considered part of belt 62. The addressable islands 74 include an upper island portion 76 and a backside contact portion 78 which extends out of the backside 70 of imaging belt 62.

The upper surface of the imaging belt also includes a mesh ground plane 80, and a thin dielectric layer 82. It should be noted the meshed ground plane is an optional feature not necessary for all embodiments to be discussed. Charging or writing to addressable islands 74 is achieved by write head array 68 making contact to backside contact portions 78, which results in formation of a latent electrostatic image on the upper surface of the imaging belt. Then toner 84 (which includes carrier beads 84*a*) from a developer nip 66*a* of the developer unit 66 are attracted to the formed electrostatic image. Thereafter the image is transferred to a substrate, such as paper, by known processes.

Charging/writing to addressable islands 74 from the backside of belt 62 completely isolates write electrodes of the write head array 68 from the side of the belt carrying the toner. This eliminates the issue of residual toner or carrier beads from interfering with the write head. In addition thin dielectric layer 82 allows toner to be provided to belt 62, such as by a conductive magnetic brush (CMB) development system, without shorting the charge stored on addressable islands 74. This is true since a CMB development system is designed where its brush portion otherwise comes into contact with the surface of the belt causing undesirable shorting and/or discharge of charge.

Additionally, it is known electrical fields exist between image and non-image regions of imaging belt 62. By use of thin dielectric layer 82, the highest lateral electric fields between the image and non-image regions are enclosed within thin dielectric layer 82 allowing for increased development voltages.

Finally, thin dielectric layer 82 can be optimized for dielectric strength and abrasion resistance when coming in contact with a cleaning blade for removing residual toner during any cleaning step, thereby avoiding damage to the conductive addressable islands.

As illustrated in FIGS. 5 and 6, the write head array 68 is positioned within contact electrography system 60 on the inside surface 70 of addressable imaging belt 62. Controller/power block 86 provides the control signals and energy for operation of the write head. It is to be understood controller/power source 86 is shown connected to write head 68, to emphasize the interconnection between these components. However, it is also to be understood controller/power source block 86 may also be the source which powers the remainder of the contact electrography system, such as that which is necessary for operating rollers 64 to motivate the addressable belt as well as movement of the developer and other components of such a system. These processes and operations are well known within the art.

Figure 7:
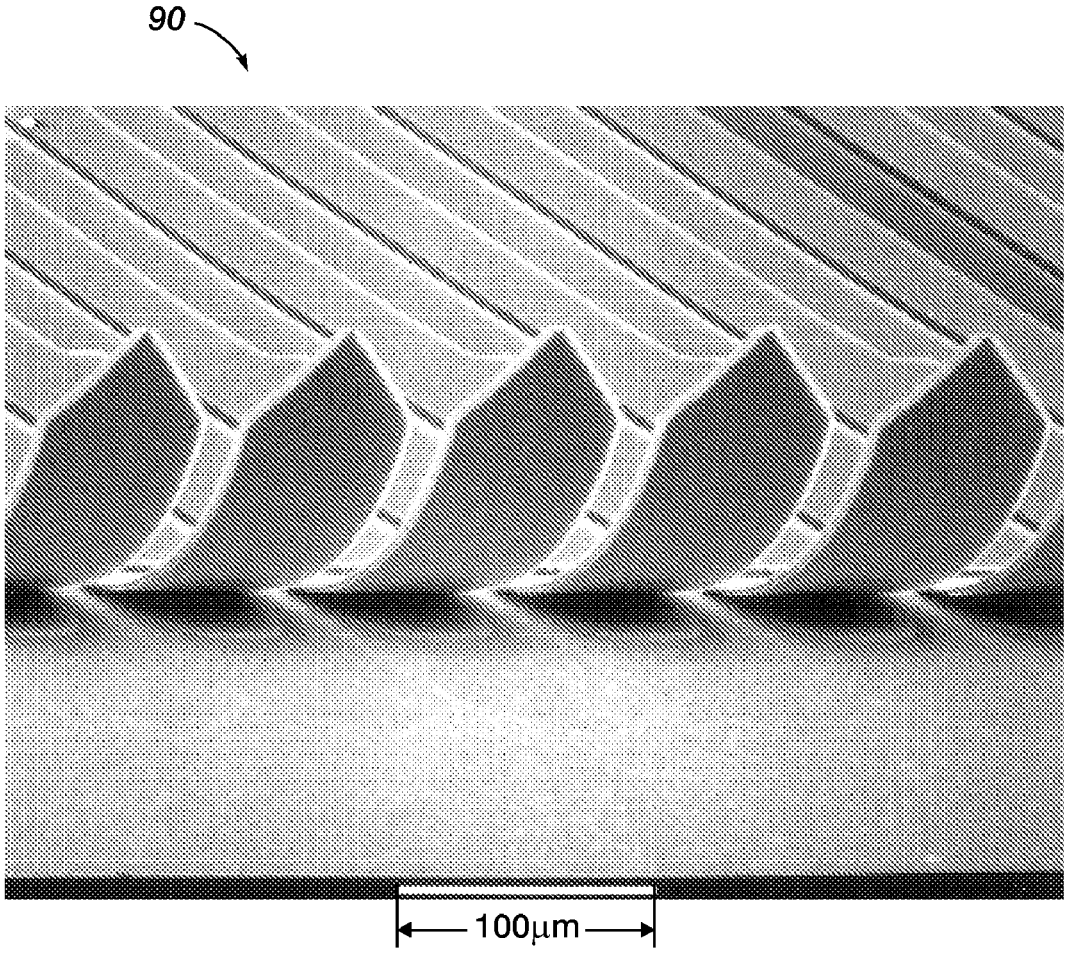
FIG. 7 is a scanning electron micrograph of a stressed metal electrode array.
Figure 8A:
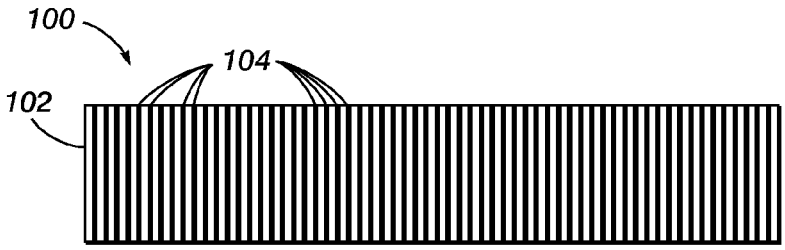
FIGS. 8A-8G show a cross-sectional depiction of the process flow used to make a backside addressable latent charge imaging belt.
Figure 8B:
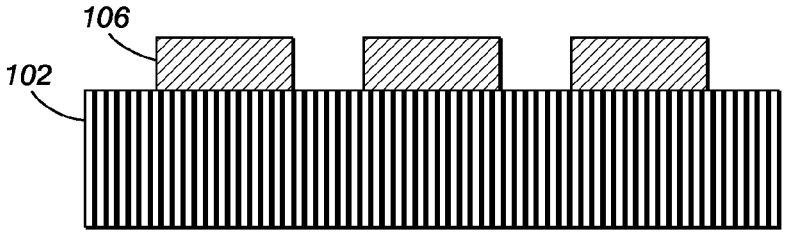
Figure 8C:
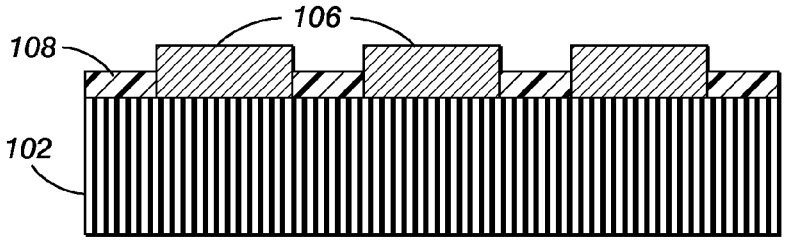
Figure 8D:
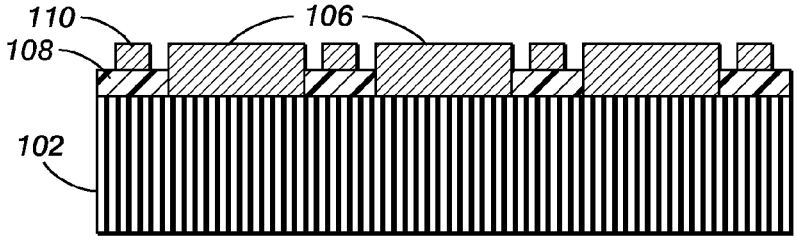
Figure 8E:
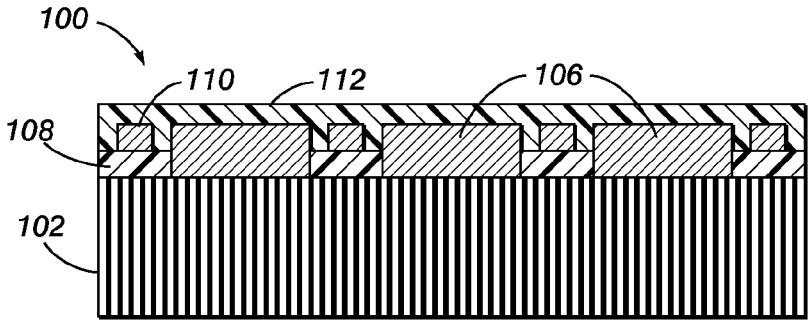
Figure 8F:
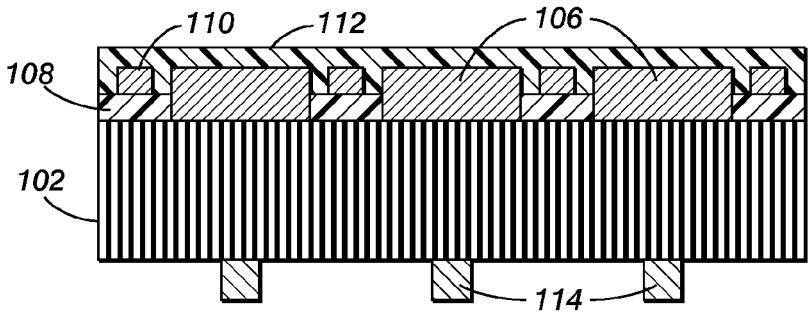
Figure 8G:
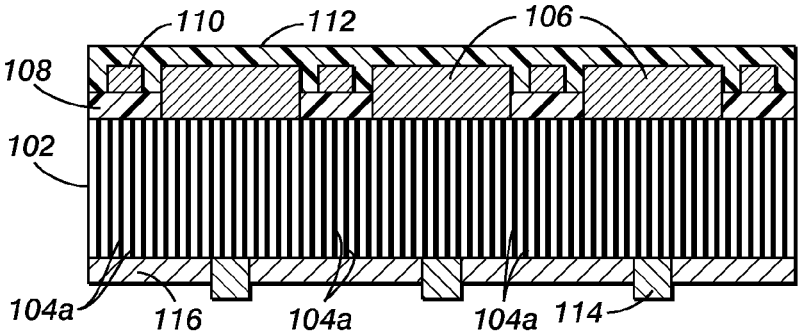

In one embodiment of the present application, the write head array 68 is made using a standard LCD foundry with a glass substrate, such as for making high voltage amorphous silicon transistors as is known in the art, and using stress metal technology for making out-of-plane electrodes as, for example, depicted in FIG. 7, which is a scanning electron micrograph of a stressed metal electrode array 90. It is to be appreciated that FIG. 7 is provided to show the concepts of stress metal technology such as those described in U.S. Pat. No. 5,914,218, entitled, "Method For Forming A Spring Contact", incorporated herein in its entirety, can be used to make out-of-plane electrodes, which in at least one embodiment is used in the present application as the electrodes or fingers of the write head array used in the present application. As will be explained in greater detail below, the ends, i.e., the cantilevered stress portions of the fingers, may be shaped with slightly oversized tips or end portions to which contact conductive pads or points are provided. Further, whereas in FIG. 7 each of the fingers or cantilevered portions are aligned, such technology can make the length of the fingers different from others, thereby having a staggered presentation.

A simple cost estimate of the write array head applicable to the present concepts, assuming the write head is made in an LCD foundry, would be about half the cost of a low end SOHO market ROS system and much lower cost than a high end ROS.

The imaging belt 62 may be manufactured from a number of materials and processes. A particular material is a high density anisotropic conductive film, which includes aligned continuous metal fibers running through the thickness of a polymer matrix. Such a material is manufactured using well known fiber composite technologies from the aerospace industry wherein dense metal fiber strands are bundled together in an hexagonal packing configuration and injected with a polymer matrix material. Once formed the structure is sliced into thin sheets typically several hundred microns thick with the fibers running through this thickness. An anisotropic conductive film can be formed if such metal fibers also have a high resistivity surface coating as could be formed from growing a thick surface oxide over the metal fibers. One such material is sold by Btechcorp Inc of Longmont, Colo. Using this material as a starting point, upper surface island and backside contacts can then be added. Turning to FIGS. 8A-8G, depicted is a cross-sectional process flow 100 of an embodiment for manufacturing the backside addressable latent charge imaging belt of the present application is shown. Step 1 (FIG. 8A), a high density anisotropic conductive film 102, having aligned continuous conductive fibers 104, is provided. The fibers extend through the film to provide an internal conductive path from the bottom surface to the top surface of the film. Step 2 (FIG. 8B), pattern the top surface with a conductive material to form island portions 106. Step 3 (FIG. 8C), apply a non-conductive material on areas 108 not corresponding to the patterned islands. Step 4 (FIG. 8D), pattern a ground plane mesh 110 on the non-conductive material. This metal mesh is an optimal step which allows for a ground plane to cover the belt. It should be noted it is not necessary for all system implementations of the addressable belt. Step 5 (FIG. 8E), a layer of dielectric material 112 is deposited on the upper surface of the belt covering the patterned conductive areas and ground plane mesh. Step 6 (FIG. 8F), provide backside contacts 114, where the backside contacts are positioned to correspond to the island portions 106 of the upper surface. This positioning of the backside contacts 114 and island portions 106 provide a defined conductive path through the aligned conductive fibers 104 of the film of Step 1. The backside contacts may be a wear resistant conductive layer. In one embodiment the wear resistant layer may be provided by an electroless plating operation. Step 7 (FIG. 8G), apply a non-conductive material 116 on the backside surface of the film at locations other than the backside contacts.

By the above process aligned conductive fibers 114*a* of the film which are not used to provide a conductive path from the backside to the front-side are isolated. More particularly, the non-conductive materials 108 and 116 act to isolate conductive fibers 114*a* from causing stray conductive paths or connections to be formed.

The above processing illustrated in FIGS. 8A-8G is to be understood as one particular manner of constructing a back side addressable latent charge imaging belt. It is, however, to be appreciated other processes and alternative arrangements of the components may be used to form alternative back addressable latent charge imaging belt embodiments. For example, if the anisotropic conductive film 102 of FIG. 8A were formed with spaced continuous conductive fibers 104, where the spacing corresponded to the desired conductive areas, then various steps of the described island patterning and forming process could be eliminated. In one example, a film having the selectively bunched fibers might form a useful device simply with the conductive film with such fibers, and a dielectric layer, such as dielectric layer material 112. Thus it should be further mentioned that if the original anisotropic composite material can be provided such that the metal fibers have good wear resistance and protrude from least one side of the belt body with adequate uniformity and spacing it would be sufficient to cover the top surface of these metal fibers with a thin non-conductive dielectric layer 112 as in Step 5 discussed above and depicted in FIG. 5E. Thus, the above further emphasizes that the concepts of this application are applicable in alternative structures other than those of the drawings, but which adhere to the concepts described herein.

Figure 9:
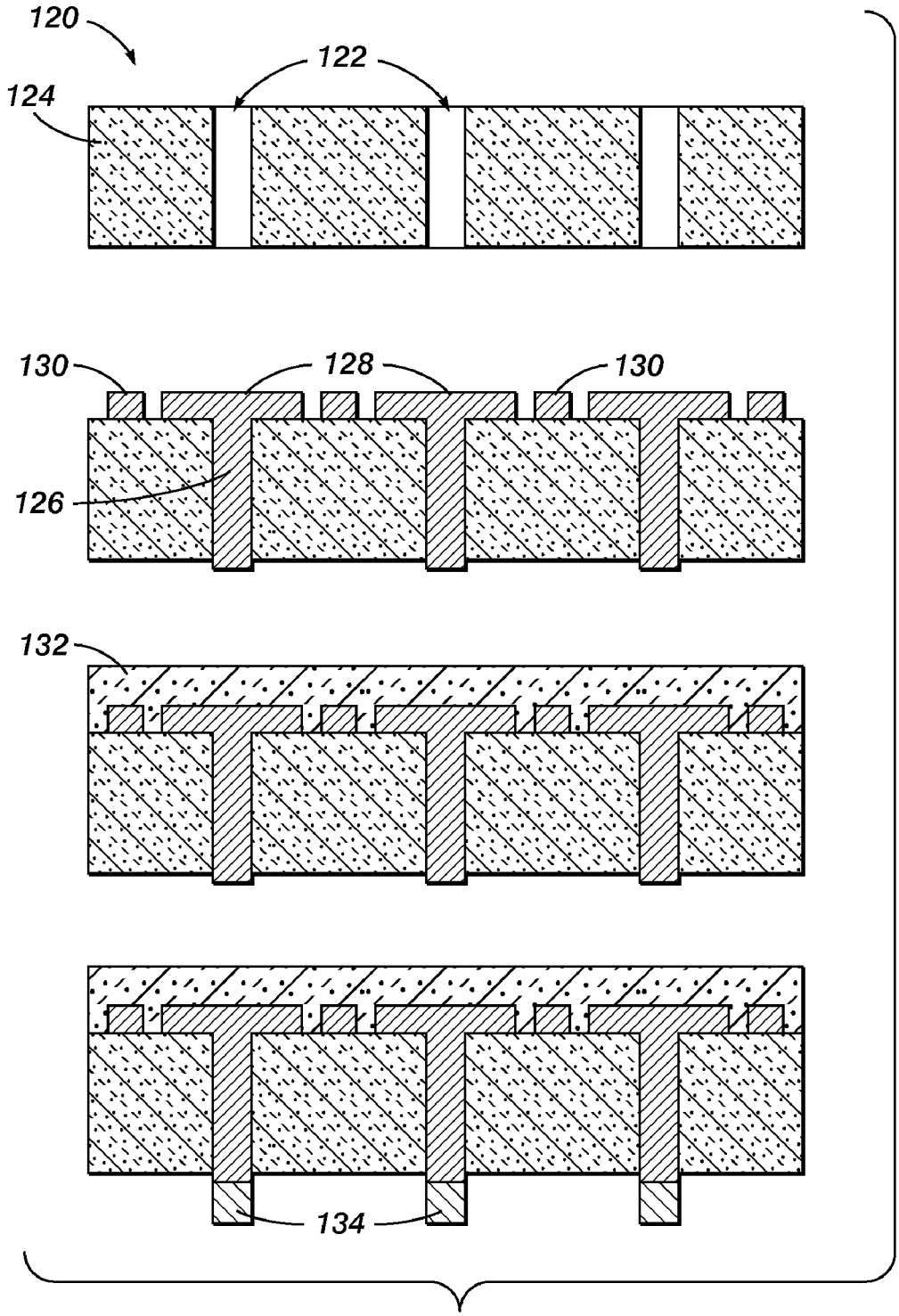
FIG. 9 is a cross-sectional depiction of another process flow used to make a backside addressable latent charge imaging belt.

It is to be appreciated other manufacturing materials and processes may be used to form the addressable imaging belt. For example, FIG. 9 shows a cross-sectional process flow 120 of another embodiment for manufacturing the addressable imaging belt, when a dielectric material not having embedded conductive fibers is used. In Step 1, thru holes 122 are formed in the dielectric belt or film 124. In Step 2, the thru holes are filled and the upper surface of the belt is covered with a conductive material (e.g., a conductive polymer or metal) 126. Then the conductive material on the upper surface is patterned into conductive areas, i.e., addressable islands 128 and ground plane mesh 130. In Step 3, a layer of dielectric material 132 is deposited on the upper surface of the belt, covering the patterned conductive areas. In one embodiment, this dielectric layer may be about 5 microns or less in thickness. In Step 4, a wear resistant conductive layer is provided (e.g., patterned or formed) to the backside of the belt at locations corresponding to the thru holes to form backside contacts 134. In one embodiment the wear resistant layer may be provided by an electroless plating operation.

One type of dielectric which may be used in Step 1 of FIG. 9 is a polyimide. The backside plated material discussed of FIGS. 9 and 10 could consist of an electroless nickel phosphorous (5-10%) which is known to have good wear resistant properties and also has an oxide layer with a low enough contact resistance to charge the islands.

Figure 10:
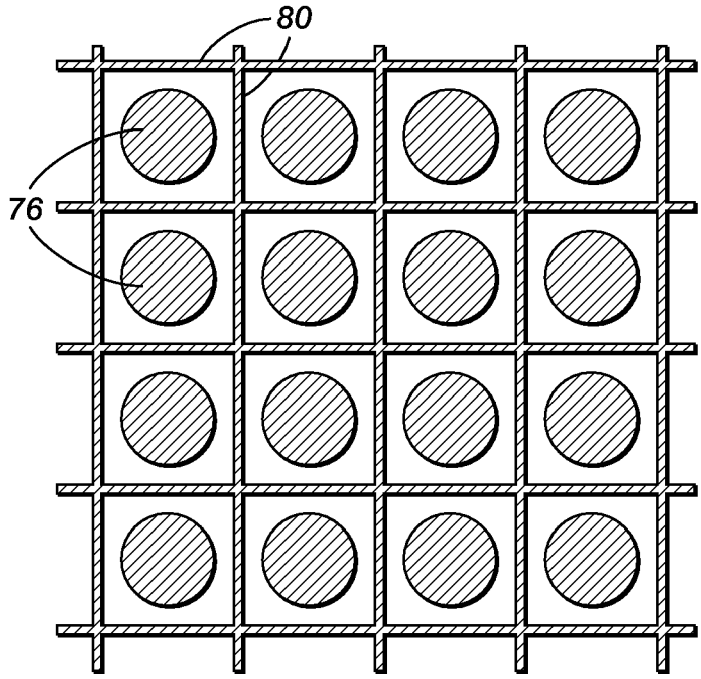
FIG. 10 shows a topside view of the charging islands situated between a ground plane mesh.

FIG. 10 shows a top view of the charging island 76 situated between ground plane mesh 80 for an addressable imaging belt configured in accordance with the process flows of FIGS. 8 or 9. The purpose of the ground plane mesh 80 is to isolate the spreading of electrostatic fields from charged to uncharged islands.

Figure 11:
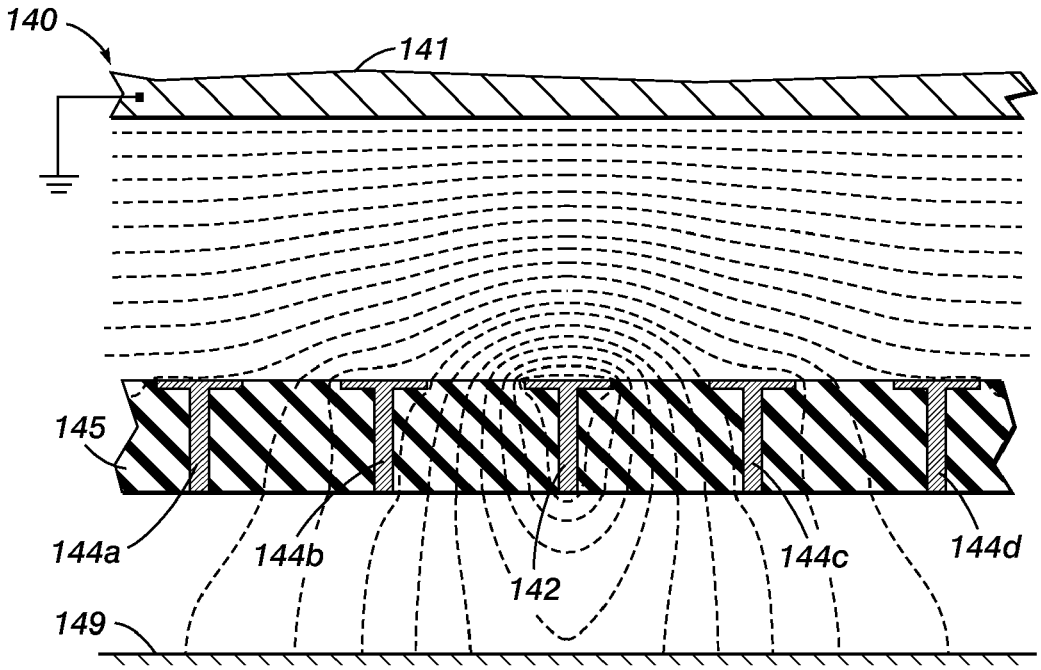
FIG. 11 is a finite element analysis simulation showing a floating islands case with no ground plane mesh.

To this issue, FIG. 11 depicts a finite element analysis (FEA) simulation 140 of an electrostatic potential pattern resulting from the interaction of a top donor surface ground plane 141 forming a development nip with an addressable belt 145 having a central addressable island 142 being charged when no ground plane mesh has been included, so island 142 is floating. A bottom ground plane 149 is also included below the belt for purposes of finite element simulation. The dashed lines represent levels of constant electrostatic potential through the nip air gap region. The figure demonstrates when no ground plane mesh is used electrostatic fields from the charged central islands undesirably spread to the neighboring islands 144*a*-144*d* due to induced electrostatic polarization, and extensive lateral spread of the electric fields act to attract toner. This simulation concentrates on the induced voltage (potential lines) and electric fields in the development region on the front side of the addressable belt.

Figure 12A:
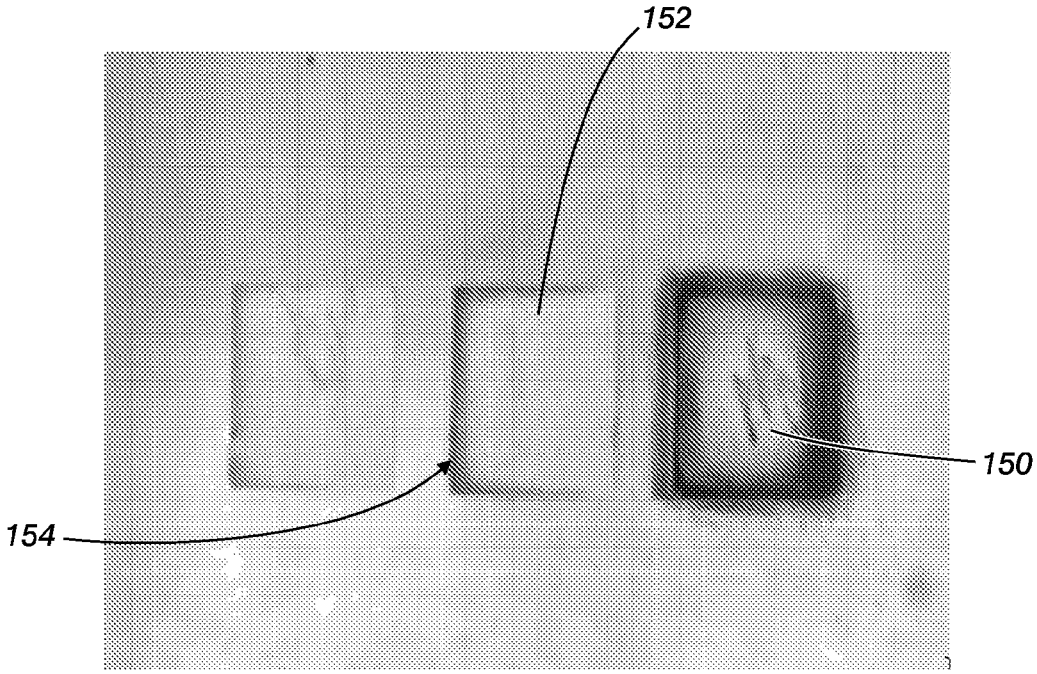
FIG. 12A is an optical micrograph of a developed toner image where charge is deposited on the right most island and an induced polarization of charge is created in the center island.
Figure 12B:
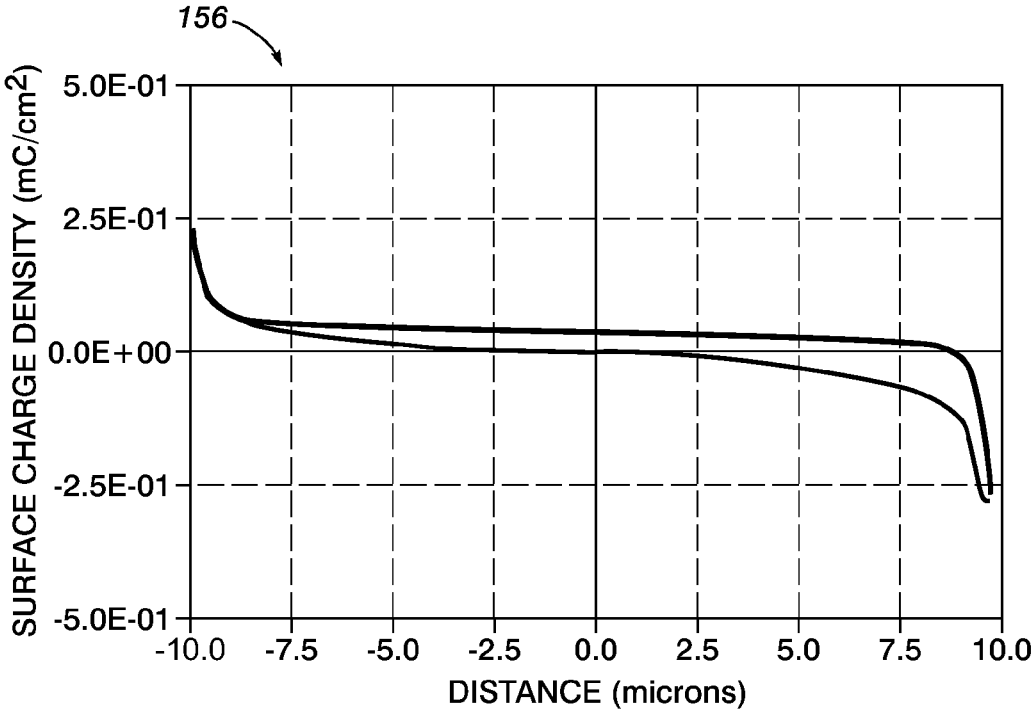
FIG. 12B is a finite element generated graph representing a calculated charge distribution along the midsection of the top and bottom surfaces of the central metal island shown in FIG. 12A

This issue of lateral induced charge polarization is demonstrated experimentally, as shown in FIGS. 12*a* and 12*b*. Here a toner image on islands without a nearby ground plane causes polarized charge in adjacent islands to develop a black toner image at the edge of the central island. More particularly, FIG. 12*a* is an optical micrograph of a developed toner image where charge is deposited on the right most island 150 and an induced polarization of charge is created in the center island 152. Toner develops on the far side of the central island (near the arrow) 154 due to this induced polarization. FIG. 12*b* is a graph 156 showing a calculated representative charge distribution along the midsection of the top and bottom surfaces of a central metal island when its nearest right hand neighboring island has been charged as is the case for FIG. 12A. It is clear the experimentally measured behavior in FIG. 12A is predicted from the simulation depicting induced charge polarization in FIG. 12B.

Figure 13:
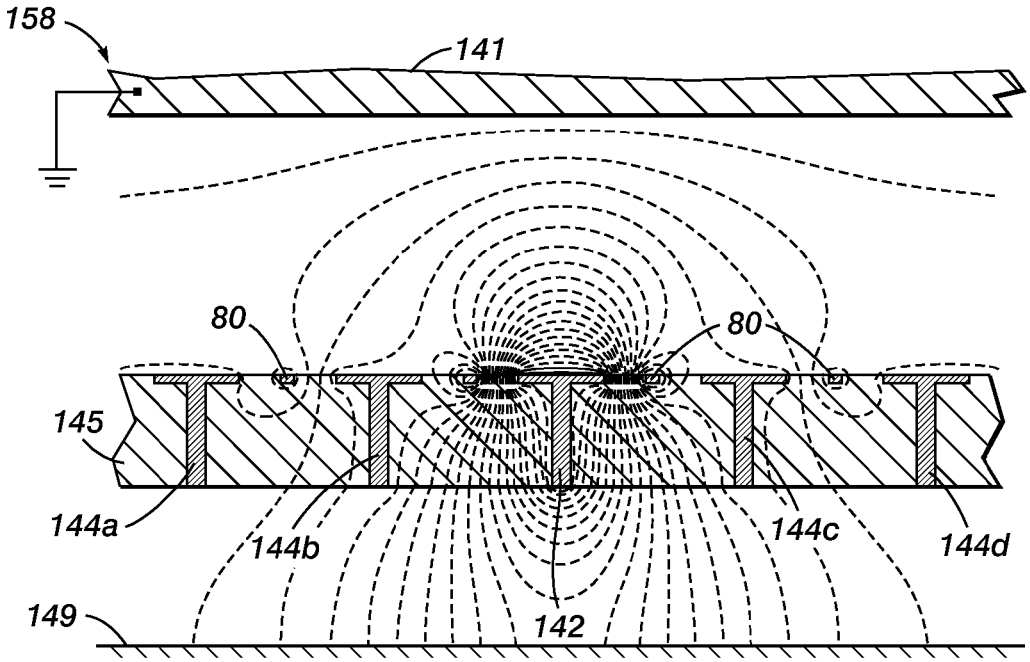
FIG. 13 shows a finite element analysis simulation of how a ground mesh plane can limit the lateral extent of the electric fields.

Once the mesh ground plane 80 is included, as shown in the finite element analysis simulation 158 of FIG. 13, the resulting potential and fields are prevented from polarizing charge in neighboring islands 144*a*-144*d* of center island 142, and the lateral electrostatic fields are isolated into individual half tone pixels, and a well-defined halftone dot can be created.

Figure 14:
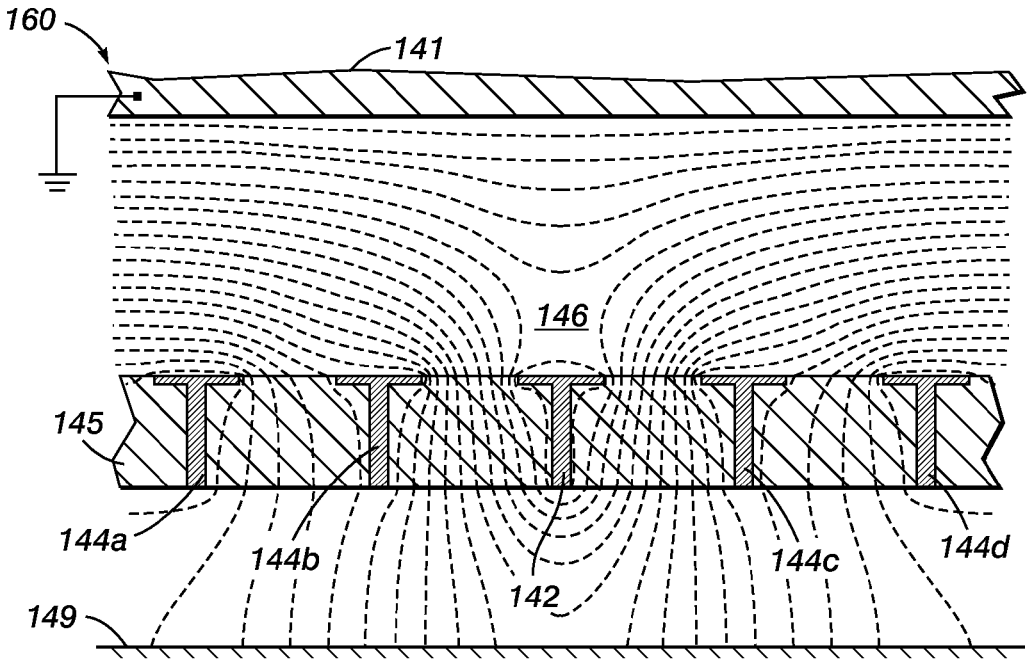
FIG. 14 shows islands charged with opposite polarities leading to field confinement without the need for a ground plane.

Turning to FIG. 14 shown is a simulation 160 of an embodiment, where even without a ground plane it is possible to isolate the lateral interactions between adjacent islands. This is accomplished by charging the islands with opposite polarities of charge. More particularly, in FIG. 14 islands 144*a*-144*d* are charged with opposite polarities from the center island 142 leading to field confinement without the need for a ground plane. In this embodiment a strong cleaning potential is also present to help sweep up toner in the non-image areas outside the central island. The stray fields will not work well for monocomponent jump systems because of a saddle point 146 in the potential above the central island 142. However two component conductive magnetic brush systems are expected to work well because toner can be presented in the attractive region below this saddle point.

Figure 15:
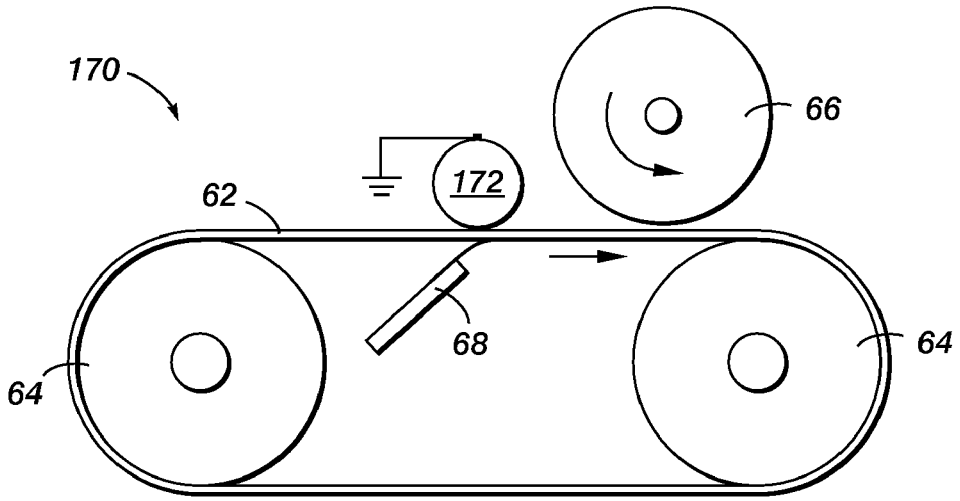
FIG. 15 is a schematic of the direct write system that could be used to load both positive and negative charge onto the conductive islands imbedded within the addressable belt by using a front side grounded roller to capacitively couple charge.

Turning to FIG. 15, a non-mesh ground plane system embodiment 170 is illustrated, which employs a ground plane roller 172 on the front side of the addressable belt (e.g., 62). The ground plane roller is used to provide enough frontside charge attracting capacitance to load charge onto the addressable islands. More particularly, system 170 can load both positive and negative charge onto the conductive addressable islands imbedded within the addressable belt by use of front side ground plane roller 172 to capacitively couple charge. This architecture requires the addressable islands be loaded with opposite charge polarities in order to achieve good lateral resolution between image and non-image areas.

It is desirable the addressable belt be made from a high dielectric strength material capable of supporting large electric fields with low residual leakage currents. Leakage currents can result in charge transfer between conductive islands and therefore reduced image resolution. If there is too much leakage the charged latent image will wash out before toner development takes place. This time frame depends on the linear speed of printing and also on the distance between the developer roll and the write head array. In the direct write case, because the island capacitance is relatively small, on the order of one femtofarad, the total RC time constant for leaking charge can be very fast unless a high purity dielectric material is used.

Figure 16:
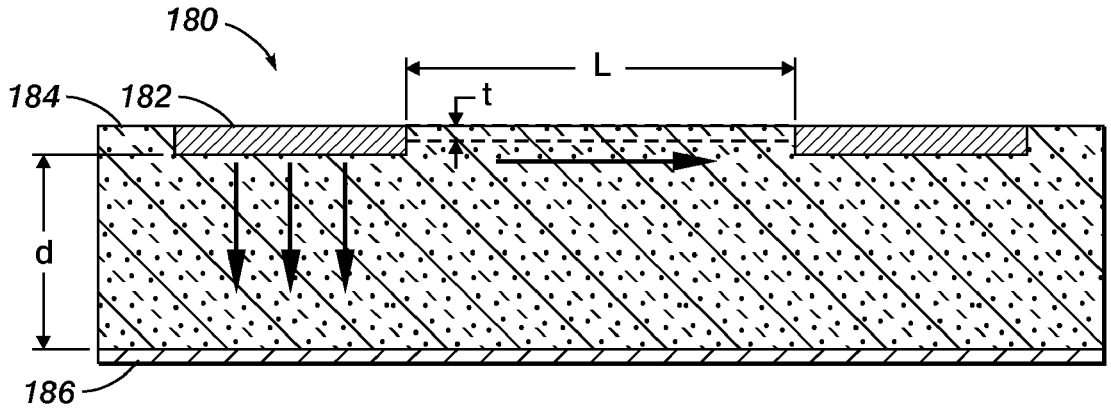
FIG. 16 is a schematic depicting the leakage of charge for charged islands near the surface and surrounded by a dielectric.

FIG. 16 is a schematic 180 depicting the leakage of charge for charged islands 182 near the surface and surrounded by a dielectric 184 with a bottom ground plane 186.

Using the variables defined in the geometry shown in FIG. 16, the RC time constants for bulk and surface diffusion of charge can be estimated. For bulk diffusion, a simple parallel plate model is appropriate where the distance from the island to the ground plane is d and L is the distance between adjacent islands. Surface diffusion may be facilitated by moisture absorption and surface defects. This imposes a further requirement on the sheet resistance at the surface (having units of ohms per square or ΩD/cm). Assuming the leakage path occurs just along the surface with a maximum thickness, t, and a characteristic of moisture absorption or chemical penetration depth of 100 nm, the RC time constant can be calculated from a measurement of the sheet resistance, Rs, using the well known four point probe method with electrodes spaced apart the same distance as the islands, L. Calculations indicate that bulk resistances above the range of 1E9 Ω-cm to 1E15 Ω-cm or more and sheet resistances in the range of 1E9 Ω-cm to 1E15 Ω/cm or more are sufficient to maintain charge on the islands for a few seconds and long enough for an image to be developed at high printing speed.

These leakage requirements are met by many modern dielectric materials used in the semiconductor and flex circuit industry. Measurements show that several polyimides (including DuPont's Kapton) and poly(ethylene naphthalene-2, 6-dicarboxylate) or PEN exhibit high dielectric strengths and low leakage currents even at high voltages.

Figure 17:
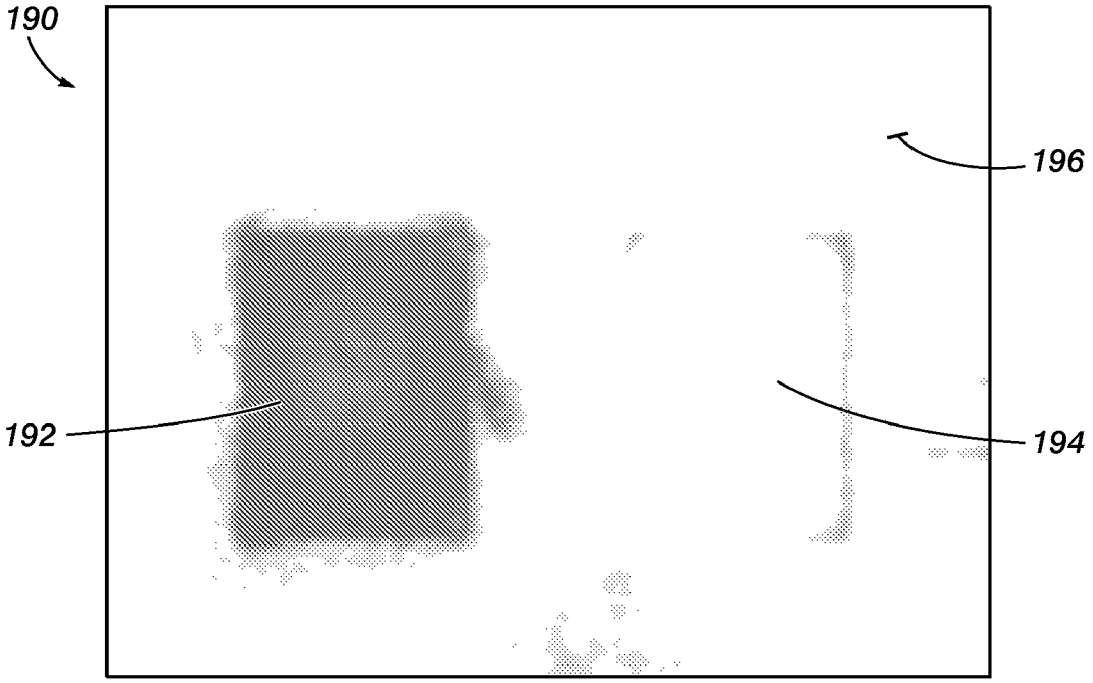
FIG. 17 is an optical micrograph of a black and white toner image developed over two adjacent island pixels formed on a polyimide membrane.

An experimental result showing the ability of polyimide to store island charge is shown in FIG. 17, which is an optical micrograph 190 of a black and white toner image developed over two adjacent island pixels 192, 194 (~1 mm in size) formed on a polyimide membrane 196. The left island 192 was set to Vapplied=300V and the right island 194 was set to 0V. Here the islands were placed over a ground plane before image development in order to suppress lateral electrostatic field effects.

Of these materials mentioned above, polyimide is the most common, being routinely used in the flexible circuit industry. Further, because charge can be stored on polyimide for several minutes, a multi-pass configuration may be possible for lower speed printing systems in which a lower density write head, or laterally scanned short head, could be used to generate the full electrostatic latent image over several passes of the imaging belt.

Returning to the embodiment of FIG. 9, recent advances in photo-patternable B-stage polymers, UV excimer laser microvia drilling, and ion track lithography have demonstrated microvia arrays with dimensions well below 42 um (i.e. 600 dpi) are all technically feasible in high quality dielectrics as thick as 100 um. Such thicknesses are typical of modern photoconductive belts.

For example, Nitto Denko Corp. has demonstrated a material with the trade name Cupil that consists of an 80 um thick dielectric material with plated z-axis conductive pillars 16 ums in diameter on a 36 um pitch.

One manufacturing process to form holes or vias in the belt is to use UV laser drilling, which has demonstrated holes as small as 10 ums in diameter through 80 um polyimide. Another laser process might employ fiber lasers with second harmonic generation to generate shorter wavelengths with CW powers as high as 1 kW to form the holes.

A third approach to defining holes includes ion track lithography. This technology uses high energy ion beams to define developed areas of polyimide.

A fourth approach is to use a micro-mold casting process. Thus, the belt may be manufactured by a number of different processes, such as those mentioned where the conductive material is a conductive polymer, or a metal plated up through the patterned holes. Further, the conductive addressable islands may be formed by selectively doping regions of the belt in order to make them conductive. The addressable islands may also be formed by selectively inducing damage in the belt material via localized energy, such as by a laser or other high energy source, to selectively transform some regions of the belt into conductive regions.

Regardless of the hole forming technique, the holes can be filled with a number of different conductive materials, including conductive polymer or plated metal. In some embodiments a conductive polymer maybe more desirable as it is more flexible than a plated metal material and this is desirable as a metal may wear or crack more easily if the belt is tensioned around a tight radius. In addition, uniform plating over such a large area is challenging though not impossible as metal meshes of this size are routinely made in the screen printing industry. Since very little current is needed to charge the islands, thru resistances as high as 1 kΩ are quite tolerable and conductive polymer materials are more than adequate.

Alignment and maintaining alignment of the electrostatic write head to the addressable belt islands, even assuming a simple straightforward pairing, is a challenge. Particularly, thermal calculations show it is challenging to keep this alignment over large temperature ranges due to coefficient of thermal expansion (CTE) differences. Further, as the belt ages stretching and/or other slight deformations will occur resulting in additional misalignment. Thus it is desirable to have a robust scheme in which exact alignment is not necessary between the electrodes and the islands. Such a scheme can be implemented by using wide contact electrodes that are staggered in their contact positions such that they will be guaranteed to make contact to each of the charging islands along the length of the belt. However, the geometry must also guarantee that no two adjacent electrodes touch the same island at the same time.

Figure 18:
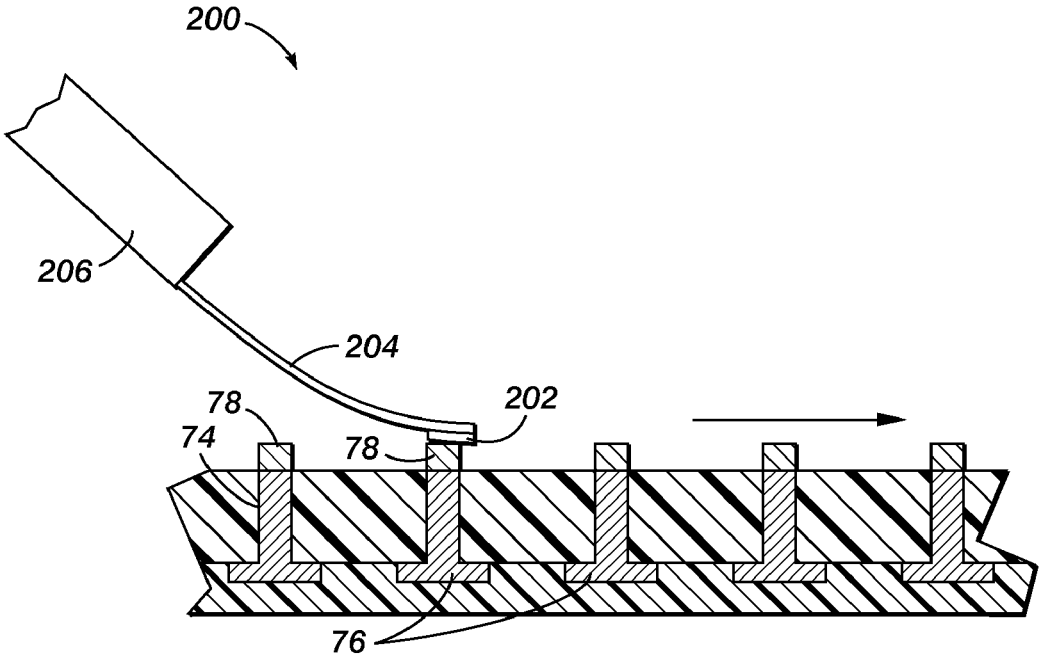
FIG. 18 is a cross-sectional depiction of the write head making contact with the backside contacts of the charging islands, with the electrode of the write head shown in more detail.

FIG. 18 is a cross-sectional depiction of write head 200 making contact with the backside contacts 78 of the charging islands 74. Shown in more detail in this figure is contact pads/points 202 on a finger/electrode 204 of write head 204. Also, depicted is an electrode holding portion and/or membrane 206 of write head 200. As has been explained preciously, and as further defined here and in the further drawings, the write head array is a linear array of cantilevered electrodes mechanically anchored at their base to a common flat substrate on which integrated circuit electronics may be fabricated in order to drive the applied voltage to the tips of the cantilevered fingers (i.e., cantilevered tips). The linear array of the cantilevered electrodes (or tips) are curled out of the plane of the substrate by means of a stress gradient in the metal used to form the linear array of cantilevered electrodes. In certain embodiments, the cantilevered electrodes are embedded through a substantial part of their length in a thin, flexible membrane (e.g., as part of electrode portion 206) of a non-conductive material which adds to the mechanical robustness. FIG. 18 will be useful in the discussion of embodiments of the write head array of the present application.

Figure 19A:
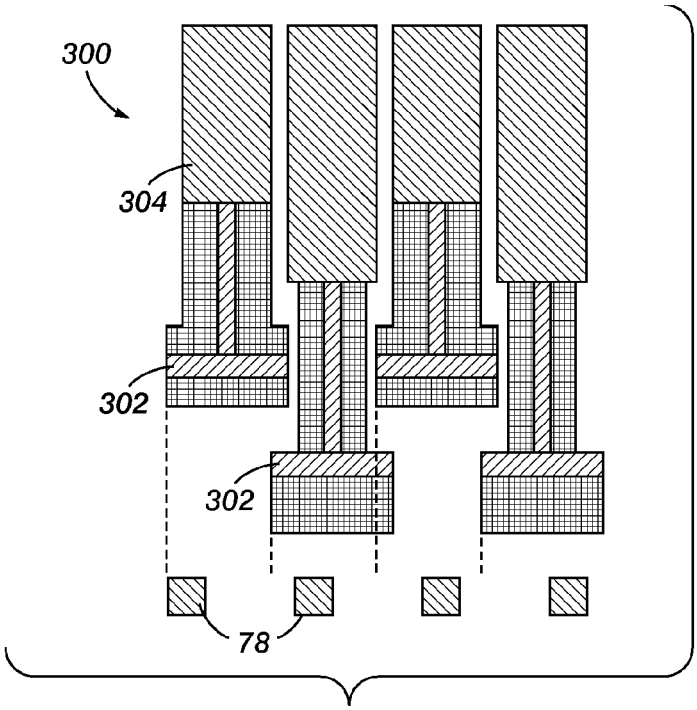
FIGS. 19A-19B provide a depiction of the write electrode geometry allowing for electrode island misalignments and slight pitch variations, the contact points have an overlap so every island will be charged to a unique potential (even if an island is recharged at a later time due to a neighboring staggered electrode that is slightly recessed)
Figure 19B:
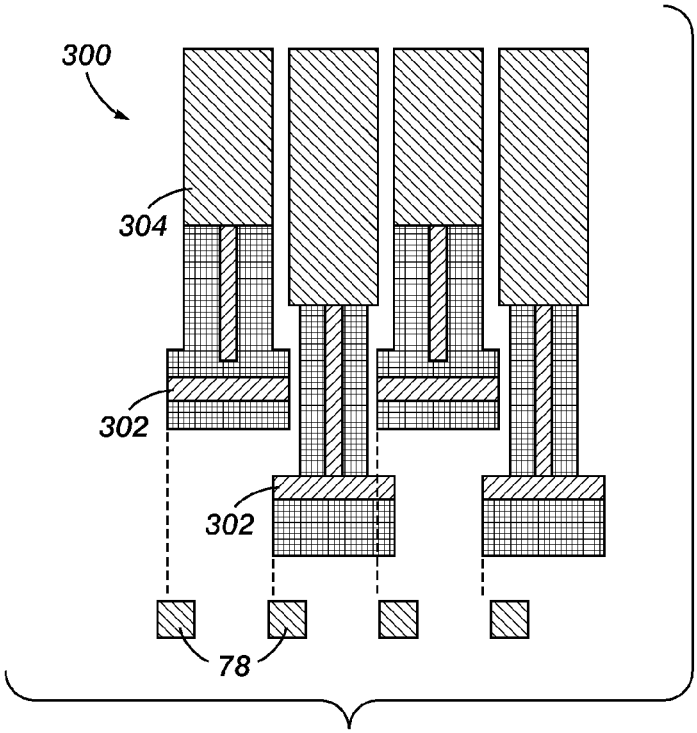

Turning now to FIGS. 19A-19B illustrated is a write head array 300 having a geometry that overcomes the above discussed misalignment issues, allowing appropriate contact even with electrode island misalignments and slight pitch variations. In FIGS. 19A-19B contact pads/points 302, similar to the contact pads/points 202 of FIG. 18, have an overlap with fingers 304 (similar to the finger 204 of FIG. 21). This overlap guarantees that every backside island contact 78 will be contacted and charged by the write head array 300 to a unique potential (even if an island is recharged at a later time due to a neighboring staggered electrode that is slightly recessed), even when the island spacing is out of phase with the electrode array spacing as is depicted in FIG. 19B. Because adjacent electrode fingers 304 are staggered at their contact pads/points 302 they will not simultaneously compete to charge up the same island with two different potentials. In addition, the use of this write head geometry also allows the alignment of the write head to have tolerance to angular misalignment during assembly.

Using existing contact electrographic technology over 20,000 write electrodes would be needed to produce copies of 1800 dpi and above when acting over an 11" span. In addition a correspondingly large number of HV transistors would be needed to drive each writing electrode. It would also be necessary to include on-board multiplexing functionality to direct anywhere from 1 to 32 bits of serially streaming input data to each of these output electrodes. This adds directly to the total real estate of the write head and therefore its cost. Thus, a further aspect of the presently disclosed concepts is the use of a time division multiplexing scheme to reduce the number of transistor arrays to address a high resolution image.

Figure 20:
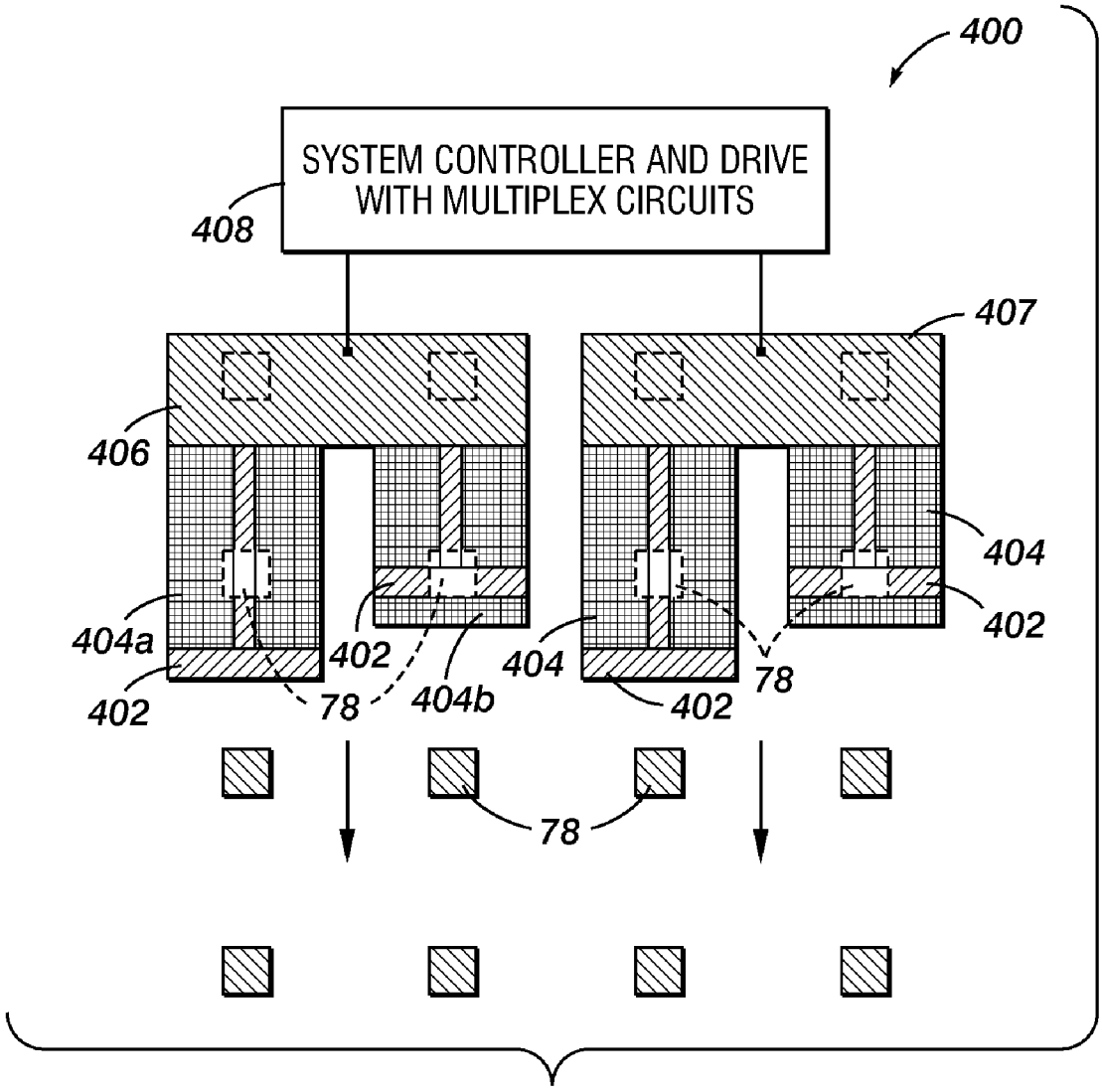
FIG. 20 is a top view of electrode fingers of the write head array, where adjacent fingers have two different lengths such that contact to the islands are made at different times allowing the same electrode (shown in yellow) to apply different voltages to two different charge storing islands without electrical interference or crosstalk.

FIG. 20 is a top view of such a time division multiplexing scheme 400. Similar to FIGS. 19A-19B, electrodes tips 402 are carried on fingers 404. However, in this scheme at least some of the fingers 404 share a same write electrode 406, 407. Further, adjacent fingers 404 have two different lengths such that contact to the islands are made at different times allowing the same common electrode 406, 407 to apply different voltages to two different charge storing islands without direct electrical interference or crosstalk. For example, the left-most electrode 406 is connected to two fingers 404*a*, 404*b*, having different lengths. As shown in FIG. 20, finger 404*b* is in contact with a backside contact 78. As the substrate carrying the backside contacts 78 is moved (towards the bottom of the page), the electrode carried on finger 404*b* will move past that back side contact, then the longer finger 404*a* will have its electrode moved into contact with a separate backside contact.

Thus in this scheme the same write electrode 406 or 407 shares one or more individual mechanical fingers 404, and by arranging the fingers 404 in a staircase fashion it is possible to have the contact pads/points 402 carried on the fingers 404, write different charges to different islands using the same common electrical drive or write electrode. This is accomplished by making use of the fact that contact pad/point will contact an individual backside island contact 78 at a different time. If a single drive electrode 406 or 407 can be shared among two backside contacts 78, it is then possible to reduce the number of on-board multiplexing transistors of a drive circuit 408 by a factor of two and thus save on the overall area of the write head and therefore its cost. This type of system requires careful timing of the electrodes to the belt and timing of the voltage pulses. In one embodiment a simple feedback system with markers on both sides of the imaging belt outside the imaging area may be used to time the writing of voltage pulses with the spacing of the islands. It should be noted that this concept could easily be extended to mechanical multiplexing that allows three, four, or more write tip cantilevers to share a single drive electrode as long as there is sufficient timing resolution and distance between addressable islands. It should be mentioned that both design elements associated with FIGS. 19 and 20 can be combined to obtain a system of fingers wherein absolute alignment to the islands along at least one axis is not required and multiplexing of the islands can still be obtain. Such a system only requires only careful angular alignment.

The contact electrography system as described above has benefits other than the elimination of the ROS subsystem.

Because polyimide and other dielectric materials are more robust to temperature and humidity variations than normal photoconductive polymers, it is possible that the use of the direct write array could allow a simplified tack transfer of toner to either an intermediate belt or paper. It is well known that electrostatic transfer can degrade image quality by increased edge raggedness from wrong sign toner. In addition electrostatic transfer sometimes leads to air breakdown and toner explosion. Tack transfer or transfusing of toner images has several desirable aspects including better substrate latitude and better edge raggedness. However, the temperatures used to tack transfer toner from neighboring surfaces typically require temperatures near 100 C. These temperatures are too high to be used with conventional organic photoconductive (OPC) materials. In fact the only commercial examples of transfusion, or tack transfer followed by toner fusion, are xerographic systems that do not use a photoconductive drum or belt. These examples include direct imaging systems sold by Oce Inc. in their commercial printing systems CPS700, CPS800, and CPS900, and the Delphax ionographic printer. In addition, HP Indigo systems can use a tack transfusion from an offset drum directly to paper.

Figure 21:
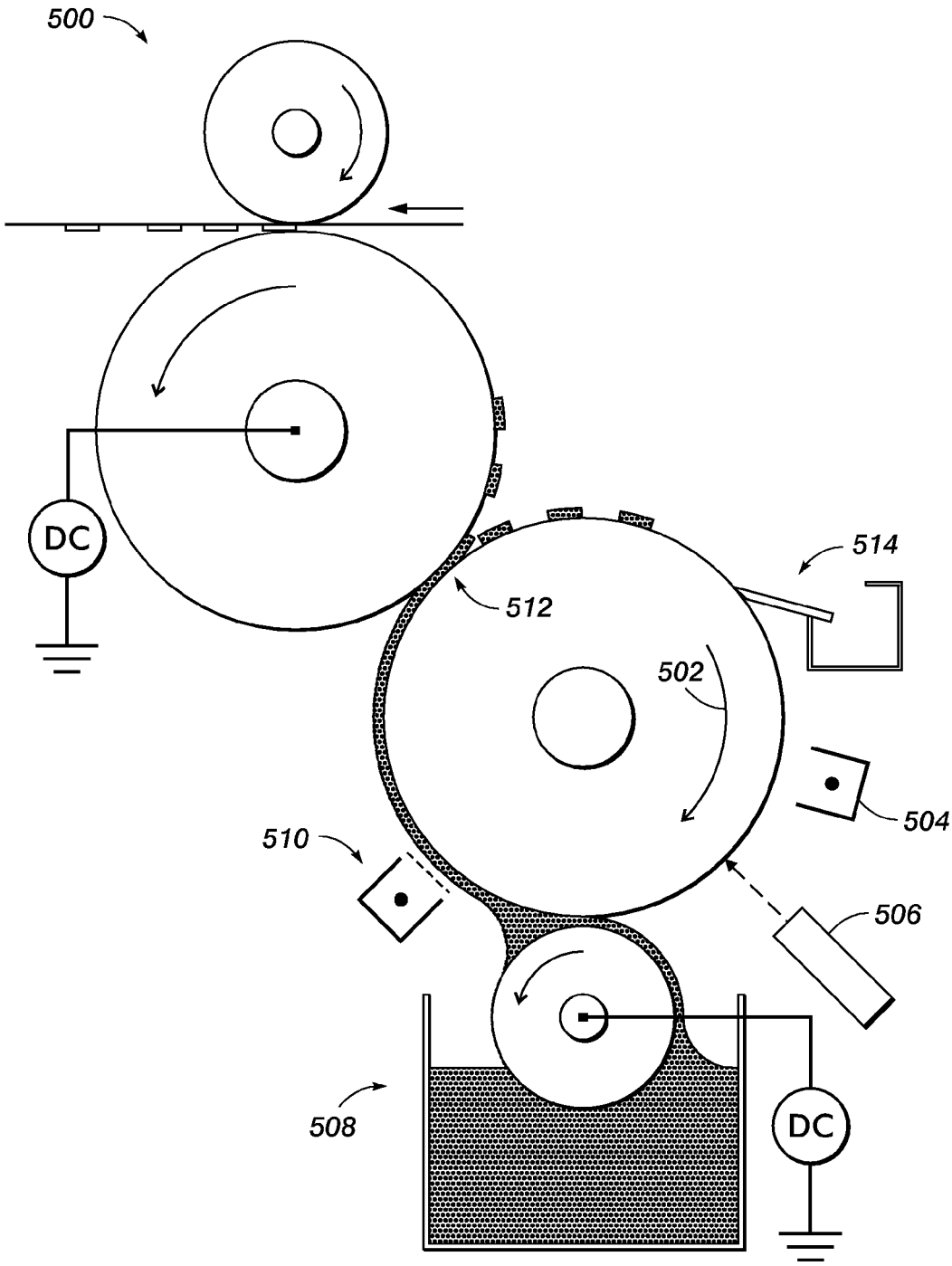
FIG. 21 is an illustration of a Contact Electrostatic Printing (CEP) system employing an imaging drum.

Finally, a contact electrographic type technology developed by Xerox Corporation under the collective acronym of CEP, or Contact Electrostatic Printing, was noted to be able to print approximately 20% solids liquid toner concentration material. FIG. 21 is an illustration of a Contact Electrostatic Printing (CEP) system 500. In this figure, 502 represents an imaging drum, 504 represents a scorotron, 506 represents a ROS system, and 508 represents a coating roller system for forming a high density liquid toner cake. 510 is a re-charge system that changes the sign of the toner cake layer charge depending upon the latent electrostatic image formed using scorotron 504 and imaging laser 506. Arrow 512 designates the point at which the cake separates into image and non-image components and the waste is cleaned using the cleaning system 514. This approach relied on a re-charge step that reversed the charge of a high solids content blanket deposited toner layer (known as a cake) doctored onto the photo drum. Image toner layers were separated under direct contact from the image roll to the blanket roll due to the sign differences of toner image and non-image areas formed during the toner re-charge step. Because toner is transferred under contact, much higher resolution than standard dry xerography was demonstrated achievable.

A drawback of this technology is that either the excess toner cake had to be cleaned off and recycled before re-imaging the surface with a ROS, or an ionographic head needed to be used in order to recharge the toner layers directly. Each of these solutions resulted in undesirable complications.

Figure 22:
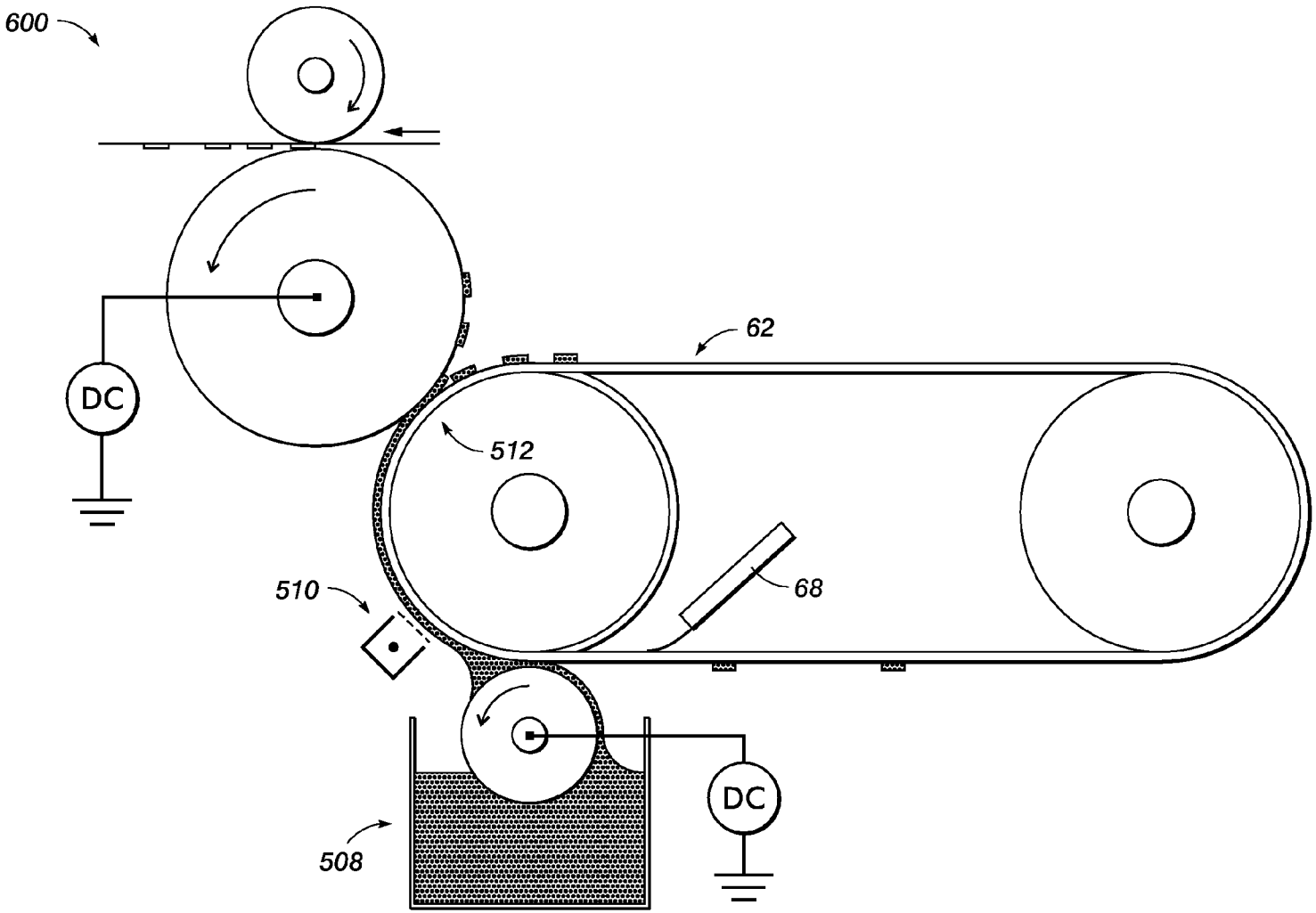
FIG. 22 is a modified CEP system, employing the addressable belt of the present application.

FIG. 22 is a modified CEP system 600, using the addressable belt of the present application in place of imaging drum 502, of FIG. 21. The use of the backside addressable belt in a CEP system offers a simpler approach than existing schemes in that the addressable belt could be used to selectively recharge a toner layer by either repelling or attracting ions from a scorotron, eliminating the need for subsystems 504 and 506. This allows addressing from the inside of the addressable belt 602 to occur without the space constrains that a full ROS system would impose, and also allows unused toner cake to remain on the imaging drum for transfer during a subsequent pass potentially eliminating cleaning system 54 for removing the excess cake.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A backside addressable imaging belt for use in printing: applications comprising:

an array of two dimensional anisotropically addressable islands which can be electrically contacted on a bottom side of the belt by means a write head consisting of an array of compliant metal cantilevered tips configured to receive a voltage, the addressable islands electrically isolated from one another and extending through the thickness of the belt in order to allow charge to flow through the belt from the bottom side of the belt to a top side of the belt, charge on the top side forming a latent electrostatic image, which may then form a printed image by attracting toner or other electrically charged marking particles to the top side.

2. The belt of claim 1 being made with a high density anisotropic conductive film, which includes aligned continuous fibers running through the thickness of a polymer matrix, at least some of the aligned continuous fibers being part of the addressable islands.

3. The belt of claim 1 being made from a polymer material having a bulk resistivity greater than 1E9 Ohm-cm in order to electrically isolate regions between the addressable islands.

4. The belt of claim 3 wherein the addressable islands are formed in the belt by selectively patterned holes in the belt which are filled with a conductive material.

5. The belt of claim 4 wherein the conductive material is a conductive polymer.

6. The belt of claim 4 wherein the conductive material is a metal plated up through the patterned holes.

7. The belt of claim 1 wherein the addressable islands are formed by selectively doping regions of the belt in order to make them conductive.

8. The belt of claim 3 wherein the addressable islands are formed by selectively inducing damage in the belt material via localized energy to selectively transform some regions of the belt into conductive regions.

9. The belt of claim 1 wherein a thin dielectric less than 5 microns in thickness is added to the top side of the belt to cover the addressable islands, to insure there is no direct electrical contact to the toner or other charged particles.

10. The belt of claim 9 wherein the thin dielectric has a bulk resistivity greater than 1E9 Ohm-cm.

11. The belt of claim 1 wherein the write head is a linear array of cantilevered electrodes mechanically anchored at their base to a common flat substrate on which integrated circuit electronics is fabricated in order to drive the applied voltage at the cantilever tips.

12. The belt of claim 1 wherein the linear array of cantilevered electrodes are curled out of the plane of the substrate by means of a stress gradient in the metal used to form the linear array of cantilevered electrodes.

13. The belt of claim 12 wherein the cantilevered electrodes are embedded through a substantial part of their length in a thin flexible membrane of a nonconductive material which adds to their mechanical robustness.

14. The belt of claim 1 where the conductive island bottom contact surface consists of a deposited nickel phosphorous alloyed material in order to provide a surface with low electrical contact resistant and high mechanical wear resistance.

15. The belt of claim 1 wherein the surface of the belt is wrapped around two or more rotating drums in a manner that allows the belt to be brought into motion relative to the write head array of cantilevered electrodes such that along this process direction the write head cantilever tips may be staggered in order to make contact with rows of conductive islands at different times such that groups of adjacent cantilevers can share a common electrical drive and a unique pattern of charge can be written to corresponding islands in contact with the adjacent cantilevers by time division of the electrical signals.

16. The belt of claim 1 wherein the cantilevered tips of the write head are staggered on the write head and each tip is wide enough along the write head such that along the process direction of the belt, every single conductive island will be contacted by a least one or possibly two cantilevered tips and thereby image-wise charged in a manner such that no two adjacent cantilever tips will interfere by trying to charge an island simultaneously and at the same time every conductive island can be image-wise charged even when a row of cantilever tips and a row of conductive islands are not well mechanically aligned in a one-to-one pairing fashion.

17. The belt of claim 1 having a thin layer of conductive material in the form of a mesh forming a ground plane that can be backside electrically contacted and serves the purpose of reducing the amount of charge polarization due to charge in neighboring islands.

18. The belt of claim 1 in which adjacent islands are separated by nearest neighbor distances less than 15 ums in a checkered or hexagonal tilting pattern such that at least 1800 dpi resolution can be realized.

19. In a printing system an addressable imaging belt for use in printing applications comprising:

a film comprised at least partially of a dielectric material;

a plurality of addressable islands formed within the film, the addressable islands electrically isolated from one another, each of the addressable islands having an island portion on an upper or imaging surface of the film and a contact portion on a backside or addressing surface of the film, wherein the backside contact of each of the addressable islands is configured to be electrically contacted by a write head consisting of an array of compliant metal cantilevered tips to which a voltage can be applied in order for a charge to flow through the film from the backside of the belt to the imaging surface of the belt, in order to form a latent electrostatic image on the imaging side so the latent image can be used to attract toner or other electrically charged particles to the imaging surface.

20. A method of generating an image using a contact imaging device having a backside addressable imaging belt configured to receive charge on a backside of the belt isolated from an imaging surface of the belt on which an image is generated, the method comprising:

generating image forming signals from a print controller;

supplying the image forming signals to a write head array;

contacting the write head array to backside contacts of the addressable imaging belt, to selectively apply charge to the backside contacts in accordance with the image forming signals; and passing the charge from the backside contacts, through the belt via conductive paths within the belt, to island portions located on the imaging surface of the belt, wherein a latent electrostatic charged image is formed on the image surface of the addressable imaging belt.

* * * * *